US010558138B2

(12) United States Patent
Tanaka et al.

(10) Patent No.: US 10,558,138 B2
(45) Date of Patent: Feb. 11, 2020

(54) IMAGE FORMING APPARATUS

(71) Applicant: CANON KABUSHIKI KAISHA, Tokyo (JP)

(72) Inventors: Masanori Tanaka, Yokohama (JP); Kazuhiro Okubo, Kawasaki (JP); Takahiro Kawamoto, Yokohama (JP); Yuji Kawaguchi, Inagi (JP); Jun Miura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/363,721

(22) Filed: Mar. 25, 2019

(65) Prior Publication Data

US 2019/0302638 A1 Oct. 3, 2019

(30) Foreign Application Priority Data

Mar. 29, 2018 (JP) ..... 2018-066096

(51) Int. Cl.
*G03G 15/02* (2006.01)
*G03G 15/043* (2006.01)
(Continued)

(52) U.S. Cl.
CPC ..... *G03G 15/0266* (2013.01); *G03G 15/043* (2013.01); *G03G 15/161* (2013.01); *G03G 21/0005* (2013.01); *G03G 21/10* (2013.01)

(58) Field of Classification Search
CPC ..... G03G 15/1675; G03G 15/0266; G03G 15/0189; G03G 15/163; G03G 15/1685
See application file for complete search history.

(56) References Cited

U.S. PATENT DOCUMENTS

2014/0016956 A1* 1/2014 Terasaki ..... G03G 15/1675 399/66
2015/0110510 A1* 4/2015 Ishikawa ..... G03G 15/1605 399/66

(Continued)

FOREIGN PATENT DOCUMENTS

JP 2001-194951 A 7/2001
JP 2002-031937 A 1/2002

(Continued)

*Primary Examiner* — Walter L Lindsay, Jr.
*Assistant Examiner* — Jessica L Eley
(74) *Attorney, Agent, or Firm* — Canon U.S.A. Inc., IP Division

(57) ABSTRACT

An image forming apparatus includes image forming units each of which includes an image bearing member, a contact charging member, and a developer bearing member of a toner, applies a charging bias in a direction in which the toner moves from the image bearing member to the charging member in an image forming period, and applied a charging bias of an opposite polarity relative to that in the image formation in a cleaning period, and collects the toner by the developer bearing member. In consecutive image formation, a charging bias in the image forming period is applied in a first interval period and which is between first and second image forming periods and a second interval period which is between second and third image forming periods. An absolute value of a charging bias applied in the second interval period is larger than that applied in the first interval period.

19 Claims, 13 Drawing Sheets

(51) Int. Cl.

| | |
|---|---|
| ***G03G 21/00*** | (2006.01) |
| ***G03G 15/16*** | (2006.01) |
| ***G03G 21/10*** | (2006.01) |

(56) References Cited

U.S. PATENT DOCUMENTS

| | | | | |
|---|---|---|---|---|
| 2016/0161887 | A1* | 6/2016 | Sugiura | G03G 15/1665<br>399/66 |
| 2018/0196386 | A1* | 7/2018 | Shiraki | G03G 15/1675 |

FOREIGN PATENT DOCUMENTS

| | | | |
|---|---|---|---|
| JP | 2003-207997 | A | 7/2003 |
| JP | 2004-191766 | A | 7/2004 |

* cited by examiner

IMAGE FORMING APPARATUS

BACKGROUND OF THE DISCLOSURE

Field of the Disclosure

The present disclosure generally relates to an image forming apparatus which forms an image on a recording medium by an electrophotographic technique.

Description of the Related Art

Electrophotographic image forming apparatuses, such as photocopiers and laser beam printers, form an electrostatic image (a latent image) by irradiating electrophotographic photosensitive members (photosensitive drums) which are uniformly charged by a charging unit with light corresponding to image data. Then a toner which is a developer, that is, a recording material, is supplied from a developing device to the electrostatic image so that the electrostatic image is visualized as a toner image. A transfer device transfers the toner image from the photosensitive drums to a recording medium, such as a recording sheet. A fixing apparatus fixes the toner image on the recording medium so as to form a recording image.

Various types of color image forming apparatus employing a tandem system which include a plurality of image forming units, which form a color image by forming toner images of different colors on the different image forming units and successively transferring the toner images on the same recording medium in an overlapping manner have been proposed.

Furthermore, charging devices of a contact system which performs charging by bringing charging members into contact with photosensitive drums have been widely used in terms of advantages of low ozone, power saving, and the like as a charging method.

In recent years, an image forming apparatus of a "cleanerless system" which does not include cleaning members which clean photosensitive drums or a waste toner accommodation portion has been proposed to miniaturize the image forming apparatus. The cleanerless system enables reuse of toners since toners remaining on photosensitive drums are collected by a developing device again, and therefore, a waste toner accommodation portion is not required. When image formation is performed by the cleanerless system, toners remaining on the photosensitive drums which have not used for the image formation are not cleaned, and therefore, portions of the toners are attached to charging members. In the image forming apparatus employing photosensitive drums of a plurality of colors and developing devices, retransferred toners which are transferred on the photosensitive drums by transfer portions of different colors are collected by charging members so that mixture of the colors of the toners is suppressed. However, if an image forming operation is continued in this state, it is possible that portions of the toners may not be collected by the charging members but may be collected by the developing devices of the other colors, and color variation can occur due to color mixture.

Accordingly, in Japanese Patent Laid-Open No. 2001-194951, a cleaning method for suppressing color variation caused by color mixture by transferring toners, periodically collected by charging members, to photosensitive drums from the charging members, and further transferring the toners to an intermediate transfer member, then discarding the toners to an intermediate transfer member cleaner has been proposed.

SUMMARY

Taking usability into consideration in a color image forming apparatus employing the cleanerless system, the number of times an operation of cleaning toners collected by charging members is performed is preferably as small as possible.

Accordingly, the present disclosure generally provides a cleanerless system which performs cleaning on charging members a reduced number of times.

According to a first aspect of the disclosure an image forming apparatus which forms a toner image on a recording material includes a plurality of image forming units each of which includes an image bearing member, a charging member which performs contact charging on the image bearing member, an exposure unit which exposes the image bearing member charged by the charging member, and a developer bearing member which forms the toner image of a normal polarity on the image bearing member, a charging voltage applying unit configured to apply a charging voltage to the charging member, and a controller configured to control the charging voltage applying unit. A remaining toner which is not used in image formation and remains on the image bearing member is collected by the developer bearing member in an image forming operation of forming the toner image in each of the image forming units. The controller controls the charging voltage applying unit such that the charging voltage is applied in a direction in which a toner charged in an opposite polarity relative to a toner charged in a normal polarity is moved from the image bearing member to the charging member in an image forming period for executing the image forming operation, and the charging voltage is applied in a direction in which the toner charged in the opposite polarity is moved from the charging member to the image bearing member in a cleaning period. Before the cleaning period, periods of time in which the image forming operation is executed to consecutively form the toner images on first to third recording materials in this order are determined as first to third image forming periods, respectively, a period of time which corresponds to an interval between the first and second image forming periods and in which the image forming operation is not executed is determined as a first interval time, and a period of time which corresponds to an interval between the second and third image forming periods and in which the image forming operation is not executed is a second interval time. The controller controls the charging voltage applying unit such that, in the first and second interval times, the charging voltage of a polarity the same as a polarity of the charging voltage in the image forming period is applied, and an absolute value of the charging voltage in the second interval time is larger than an absolute value of the charging voltage in the first interval time.

Further features of the present disclosure will become apparent from the following description of exemplary embodiments with reference to the attached drawings.

DESCRIPTION OF THE EMBODIMENTS

First Embodiment

Hereinafter, developing devices, cartridges, and an image forming apparatus according to the present disclosure will be described in detail with reference to the accompanying drawings. Note that sizes, quality of materials, shapes, and relative arrangement of components described in embodiments below are to be appropriately changed depending on a configuration of an apparatus to which the present disclosure is applied and various conditions. Accordingly, the scope of the present disclosure is not limited to those described in the present disclosure unless otherwise specified.

1. Image Forming Apparatus

Figure 1:
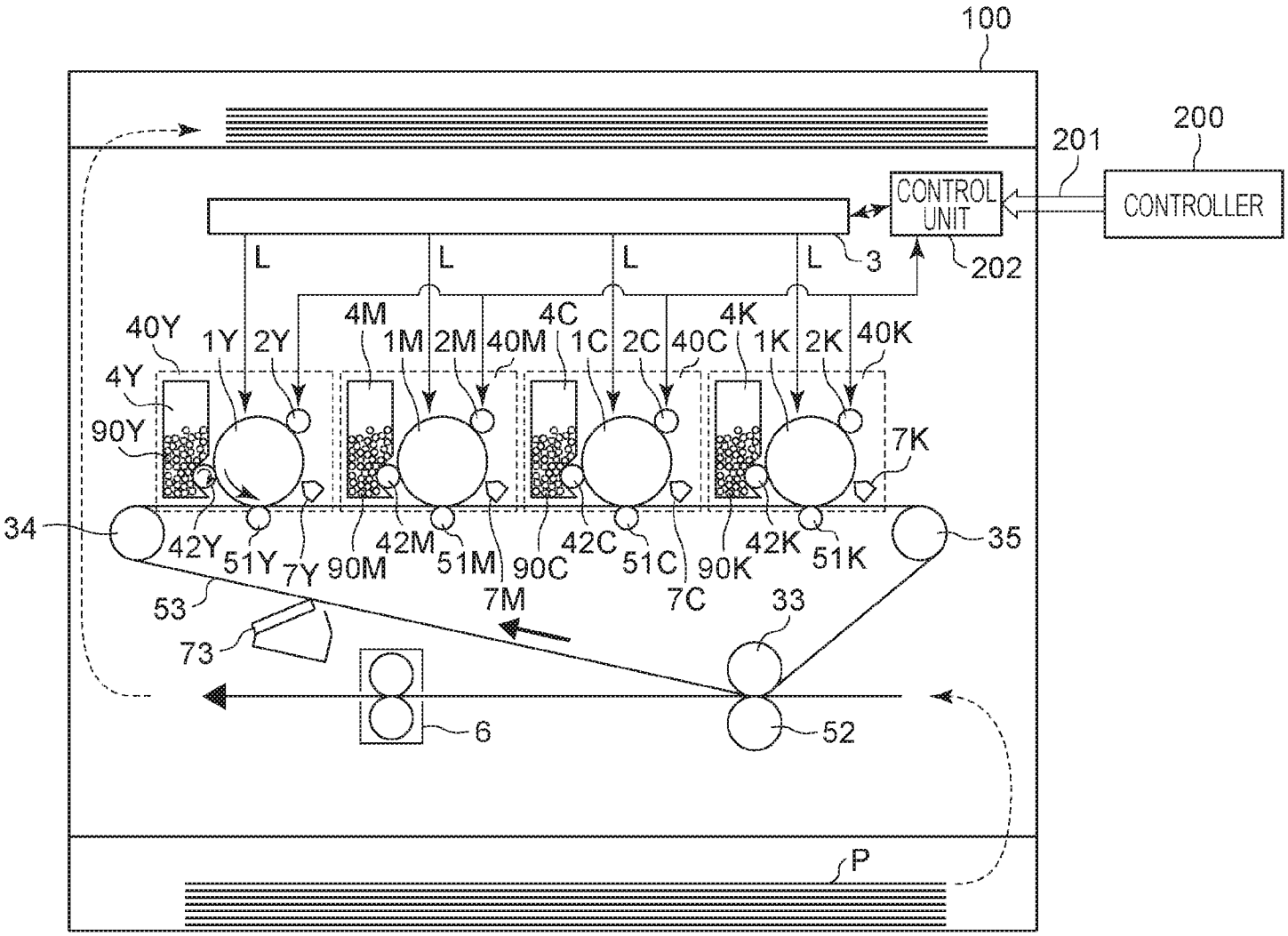
FIG. 1 is a diagram schematically illustrating an image forming apparatus according to a first embodiment.

This embodiment relates to an image forming apparatus employing a cleanerless system which does not include a cleaning member as a cleaning unit of an image bearing member. FIG. 1 is a diagram illustrating an example of an image forming apparatus 100. In FIG. 1, image forming stations for four colors are illustrated, that is, image forming stations for forming images of yellow, magenta, cyan, and black from left of FIG. 1. Characters Y, M, C, and K attached to reference numerals in FIG. 1 indicate components of the stations which form toner images of yellow, magenta, cyan, and black, respectively, on image bearing bodies. A tubular photosensitive drum 1 serving as the image bearing member rotates with a shaft thereof at a center. After a surface of the photosensitive drum 1 is uniformly changed by a charging roller 2 serving as a contact charging device, a latent image is formed by an exposure device 3 serving as an exposure unit. The charging roller 2 includes a core metal and a conductive elastic body layer integrally formed around the core metal in a concentric manner, and a charging bias applying unit, not illustrated, applies a charging bias (a charging voltage) to the core metal. A developing device 4 accommodates a toner 90 serving as a one-component developer. The toner 90 having a predetermined charge polarity is supplied to an electrostatic latent image on the photosensitive drum 1 by a developing roller 42 serving as a developer bearing member and visualized as a toner image. The developing roller 42 includes a core metal and a conductive elastic body layer integrally formed around the core metal in a concentric manner, and a developing bias applying unit, not illustrated, applies a developing bias (a developing voltage) to the core metal. The toner image on the photosensitive drum 1 is electrostatically transferred on the intermediate transfer member by a primary-transfer roller 51 serving as a transfer member to which a transfer bias (a transfer voltage) has been applied by a transfer bias applying unit, not illustrated. The primary-transfer roller 51 is configured as a roller having a conductive elastic layer on a shaft thereof, and a transfer bias is applied to the shaft. Toners of different colors are successively transferred on an intermediate transfer belt 53 serving as the intermediate transfer member so as to form a full-color toner image. Thereafter, the full-color toner image is transferred on a sheet P serving as a recording medium by a secondary transfer unit 52 and subjected to thermal melting and color mixture performed by a fixing unit 6 on the sheet P so as to be fixed as a permanent image. Then the sheet P is discharged.

The image forming apparatus 100 of this embodiment includes the exposure device 3 which exposes photosensitive drums 1Y, 1M, 1C, and 1K provided for process cartridges 40Y, 40M, 40C, and 40K, respectively. A time-series electric digital pixel signal indicating image information which has input to a control unit 202 through an interface 201 from a printer controller 200 and which has been subjected to image processing is supplied to the exposure device 3. The exposure device 3 includes a laser output unit which outputs a laser beam modulated in accordance with the supplied time-series electric digital pixel signal, a rotatable polygonal mirror (a polygon mirror), an fθ lens, a reflection mirror, and the like and performs main scanning exposure on a surface of the photosensitive drum 1 using a laser beam L. An electrostatic latent image corresponding to the image information is formed by the main scanning exposure and sub-scanning performed by rotation of the photosensitive drum 1.

The intermediate transfer belt 53 is disposed so as to abut on the photosensitive drums 1Y, 1M, 1C, and 1K, and electric resistance value (volume resistivity) is $10^{11}$ to $10^{16}$ (Ω·cm). The intermediate transfer belt 53 has a thickness in a range from 100 μm to 200 μm, and is formed as an endless shape by a resin film, such as polyvinylidene fluoride (PVdf), nylon, polyethylene terephthalate (PET), or polycarbonate (PC). Furthermore, the intermediate transfer belt 53 is tensed by a secondary transfer opposing roller 33, a driving roller 34, and a tension roller 35 and is driven in a circulating manner at a process speed when the driving roller 34 is rotated by a motor, not illustrated. The primary-transfer roller 51 is configured as a roller having the conductive elastic layer on a shaft thereof. The individual primary transfer rollers 51 are disposed substantially in parallel to the respective photosensitive drums 1 and abut on the photosensitive drums 1 by a predetermined pressing force through the intermediate transfer belt 53. A transfer electric field is formed on the shaft of the primary-transfer roller 51 when a direct current (DC) voltage of a positive polarity is applied.

The secondary transfer roller 52 is disposed so as to face the secondary transfer opposing roller 33 through the intermediate transfer belt 53 and held while an appropriate pressure is applied to the secondary transfer unit 52. When a DC voltage of a positive polarity is applied, the transfer electric field is formed on the secondary transfer unit 52.

The fixing unit 6 includes a fixing roller heated by a fixing heater and a pressure roller which is pressed onto the fixing roller by a predetermined pressing force.

A belt cleaning member 73 abuts on the intermediate transfer belt 53 toward a downstream side in a rotation direction of the intermediate transfer belt 53 relative to a secondary transfer position.

A sheet supply unit includes a cassette which accommodates sheets P and a pickup roller which feeds the sheets P one by one from the cassette.

Although a toner image formed on the photosensitive drum 1 is transferred to the intermediate transfer belt 53 by the primary-transfer roller 51, a portion of the toner is not transferred and remains on the photosensitive drum 1 as transfer remaining toner. The transfer remaining toner remaining on the photosensitive drum 1 is a toner having a normal polarity of a small charge amount or an opposite polarity toner having a charge of an opposite polarity. Furthermore, the toner transferred on the intermediate transfer belt 53 by the primary-transfer roller 51 may also become an opposite polarity toner having charge of an opposite polarity since the toner has received discharge when passing the primary-transfer roller 51 in the station on a downstream side in a rotation direction of the intermediate transfer belt 53. The opposite polarity toner is electrically attached to the photosensitive drum 1 in the station on the downstream side as a retransferred toner. The transfer remaining toner and the retransferred toner will be described hereinafter in detail.

A pre-charge exposure device 7 serving as a second exposure device is disposed on a downstream side relative to a contact portion between the photosensitive drum 1 and the primary-transfer roller 51 in a rotation direction of the photosensitive drum 1 and on an upstream side relative to a contact portion between the charging roller 2 and the photosensitive drum 1. The pre-charge exposure device 7 performs optical neutralization on a surface potential of the photosensitive drum 1 before the photoconductive drum 1 enters a charging portion so that stable discharge is performed in the charging portion which is the contact portion between the charging roller 2 and the photosensitive drum 1. As described above, the transfer remaining toner indicates a toner which is charged in a positive polarity which is an opposite polarity of a normal polarity or a toner which does not have sufficient charge although the toner is charged in a negative polarity which is the normal polarity. Since the photosensitive drum 1 is neutralized by the pre-charge exposure device 7, uniform discharge may be performed at a time of charge processing, and simultaneously, the transfer remaining toner may be uniformly charged in a negative polarity.

Even when transfer is performed on a recording medium from the intermediate transfer belt 53 using the secondary transfer unit 52, a portion of the toner is not transferred and remains on the intermediate transfer belt 53 as a secondary-transfer remaining toner. The secondary-transfer remaining toner is removed from the intermediate transfer belt 53 by the belt cleaning member 73 and discarded in a waste toner container.

2. Cleanerless System

Figure 2A:
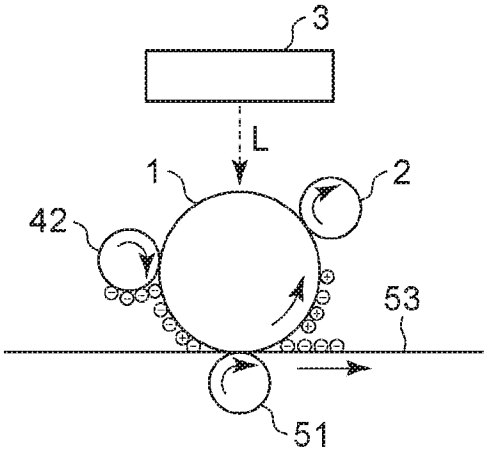
FIGS. 2A to 2E are diagrams illustrating a method for collecting primary-transfer remaining toners according to the first embodiment.
Figure 2B:
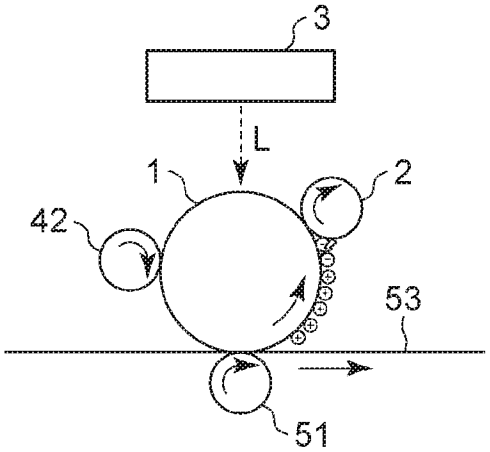
Figure 2C:
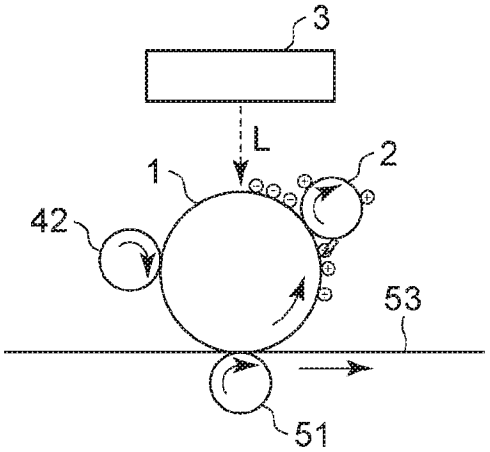

A phenomenon generated in operations of individual process cartridges when the cleanerless system is executed in this embodiment will be described with reference to FIGS. 2A to 2E. As illustrated in FIG. 2A, after a toner image developed on the photosensitive drum 1 is primarily transferred on the intermediate transfer belt 53, a portion of a toner which has not been primarily transferred remains on the photosensitive drum 1 as a primary-transfer remaining toner. If a cleaning member is employed, the primary-transfer remaining toner is collected by the cleaning member. However, the cleanerless system does not have a cleaning device for collecting the primary-transfer remaining toner. Accordingly, the toner on the photosensitive drum 1 enters the charging roller 2 without being cleaned. The primary-transfer remaining toner which enters the charging roller 2 is a toner of a normal polarity or a toner of an opposite polarity which has a small charge amount. The primary-transfer remaining toner is charged in a negative polarity which is a normal polarity which is the same as that of the photosensitive drum 1 when receiving discharge in an electric field by a charging bias in a gap portion formed before a contact portion (a charging nip) between the charging roller 2 and the photosensitive drum 1 as illustrated in FIG. 2B. Since the charge amount of the primary-transfer remaining toner is small, the primary-transfer remaining toner is easily affected by the discharge and is likely to have a negative polarity which is a normal polarity due to the discharge. Accordingly, a charging bias in the charging nip becomes larger than a surface potential of the photosensitive drum 1 in a negative value, and therefore, the primary-transfer remaining toner which has been charged in the negative polarity is not attached to the charging roller 2 and passes through the charging roller 2 as illustrated in FIG. 2C. A portion of the toner of the opposite polarity which has entered the charging roller 2 without receiving the discharge is electrically attracted by the charging roller 2. The toner of the opposite polarity is appropriately collected by the belt cleaning member 73 in a cleaning operation described below.

Figure 2D:
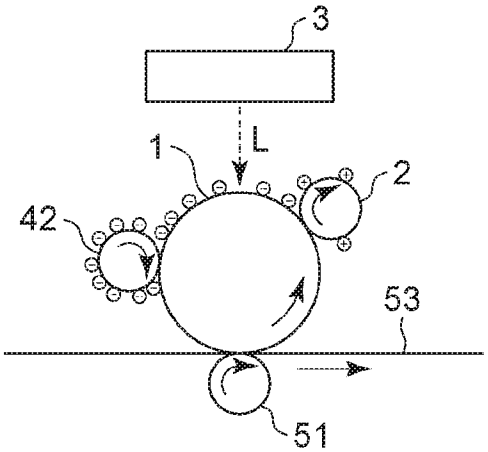
Figure 2E:
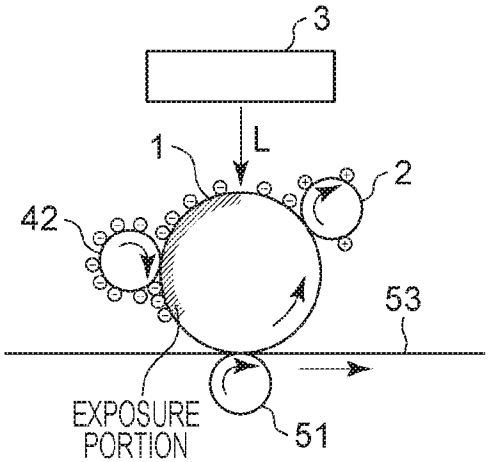

The primary-transfer remaining toner which has passed through the charging nip reaches a laser irradiation position in accordance with rotation of the photosensitive drum 1. An amount of the primary-transfer remaining toner is not so large that a laser beam emitted from the exposure device 3 is not blocked, and therefore, the primary-transfer remaining toner does not affect a process of forming an electrostatic latent image on the photosensitive drum 1 and reaches a contact portion (a developing nip) between the developing roller 42 and the photosensitive drum 1. As illustrated in FIG. 2D, the toner in a non-exposure portion on the photosensitive drum 1 is electrically collected by the developing roller 42 due to the potential relationship between the surface potential of the photosensitive drum 1 and the developing bias (a dark area potential (Vd) of −550 V in the photosensitive drum 1 and a developing bias of −400 V). As illustrated in FIG. 2E, the toner in an exposure portion on the photosensitive drum 1 remains on the photosensitive drum 1 since the toner is not collected by the developing roller 42 due to the potential relationship between the surface potential of the photoconductive drum 1 and the developing bias (a light area potential (V1) of −140 V in the photosensitive drum 1 and a developing bias of −400 V). However, the toner 90 is electrically supplied from the developing roller 42 to the exposure portion on the photosensitive drum 1. Therefore, the primary-transfer toner is also transferred again with the toner 90 supplied from the developing roller 42. The developing bias in this embodiment is represented as a potential difference relative to an earth potential. Accordingly, the developing bias of −400 V means that a potential difference of −400 V is generated due to the developing bias applied to the core metal of the developing roller 42 relative to the earth potential (0 V). This is true of the charging bias and the transfer bias described below.

In this way, the primary-transfer remaining toner which is not transferred on the sheet P but remains on the photosensitive drum 1 is collected by the developing device 4 in the non-exposure portion and is transferred from the photosensitive drum 1 with the toner 90 which has been newly developed in the exposure portion. The toner collected by the developing device 4 is used after being mixed with the toner 90 in the developing device 4. Accordingly, each cartridge may effectively utilize a toner of an own color.

Next, a phenomenon which is generated in a case where a plurality of process cartridges employ the cleanerless system will be described with reference to FIGS. 3A to 3D. In this embodiment, the four process cartridges are arranged as illustrated in FIG. 1, and a case where an image is formed using the cartridge 40Y disposed on an uppermost stream in a rotation direction of the intermediate transfer belt 53 is taken as an example. Here, the process cartridge 40Y disposed on the uppermost stream and the process cartridge 40M disposed on a downstream side relative to the process cartridge 40Y are used for a description of the phenomenon. The same phenomenon as the process cartridge 40M is generated in the process cartridges 40C and 40K which are disposed on a further downstream side, and therefore, a description thereof is omitted.

Figure 3A:
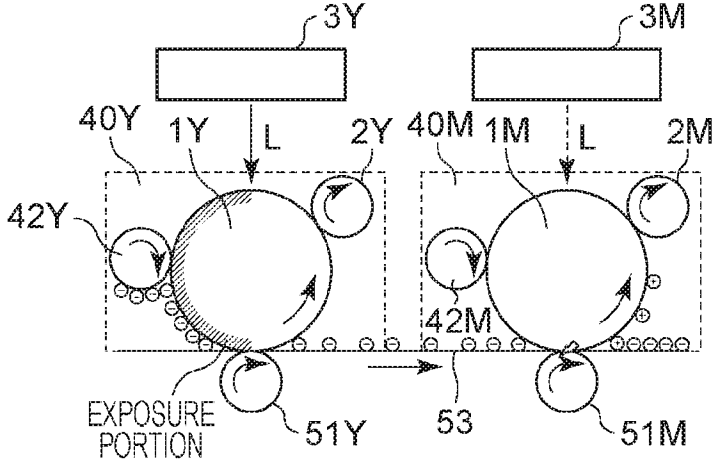
FIGS. 3A to 3D are diagrams illustrating a method for collecting retransferred toners according to the first embodiment.

A yellow toner 90Y on the intermediate transfer belt 53 which has been primarily transferred by the process cartridge 40Y disposed on the uppermost stream passes a primary-transfer position (the contact portion between the photosensitive drum 1 and the primary-transfer roller 51) of the process cartridge 40M disposed on the downstream side. As illustrated in FIG. 3A, before the passing, a polarity of a portion of the yellow toner 90Y on the intermediate transfer belt 53 is inverted in the primary-transfer position of the process cartridge 40M due to discharge in the transfer nip. Then the yellow toner 90Y of the opposite polarity in which the polarity has been inverted is transferred on the photosensitive drum 1M again due to a potential difference between the photosensitive drum 1M and the primary-transfer roller 51M. This phenomenon is referred to as retransfer. The yellow toner 90Y transferred on the photosensitive drum 1M enters the charging roller 2M in the cleanerless system which does not include any cleaning member.

Figure 3B:
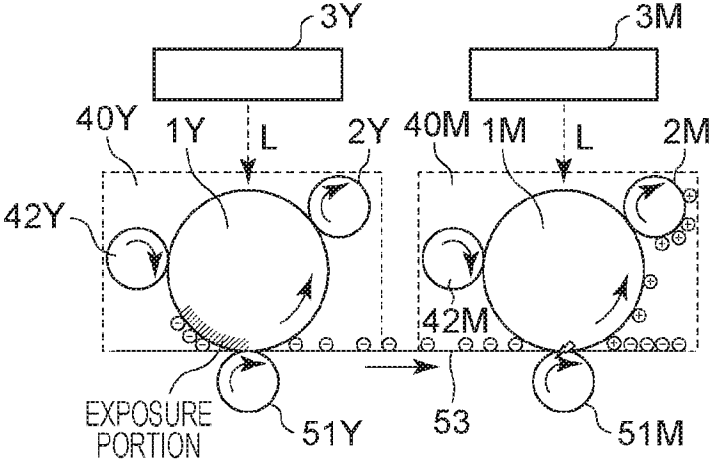

As with the case of the primary-transfer remaining toner described above, when the retransferred toner has passed the charging roller 2 after discharge, a toner of another color enters the developing device 4. Accordingly, a toner of a cartridge of a different color which is other than the primary-transfer remaining toner on the photosensitive drum 1 is mixed with another cartridge. If the retransferred toner is mixed with the toner 90 in the developing device 4, color mixture occurs, and an original color is deteriorated. Therefore, according to this embodiment, the retransferred toner is temporarily transferred to the charging roller 2M as illustrated in FIG. 3B so that the color mixture is suppressed. A charge amount of the retransferred toner is larger on the opposite polarity side than that of the primary-transfer remaining toner, and therefore, it is not likely that the retransferred toner has a normal polarity doe to discharge. The retransferred toner is easily moved to the charging roller 2 since the retransferred toner is less affected by opposite caused by discharge. Accordingly, the retransferred toner held by the charging roller 2 is electrically attached on the charging roller 2.

Figure 3C:
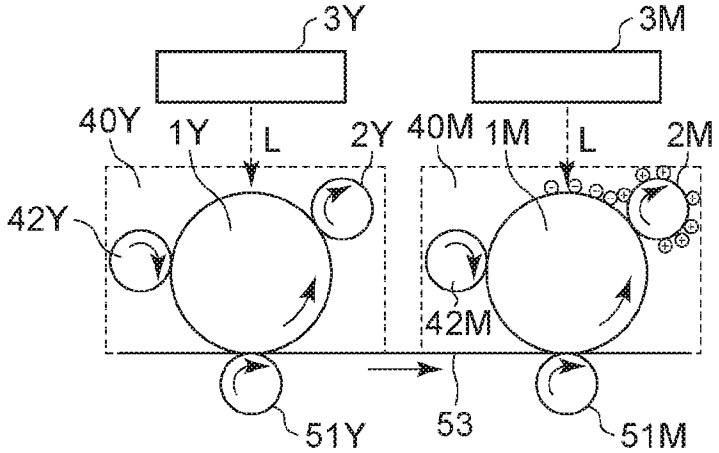
Figure 3D:
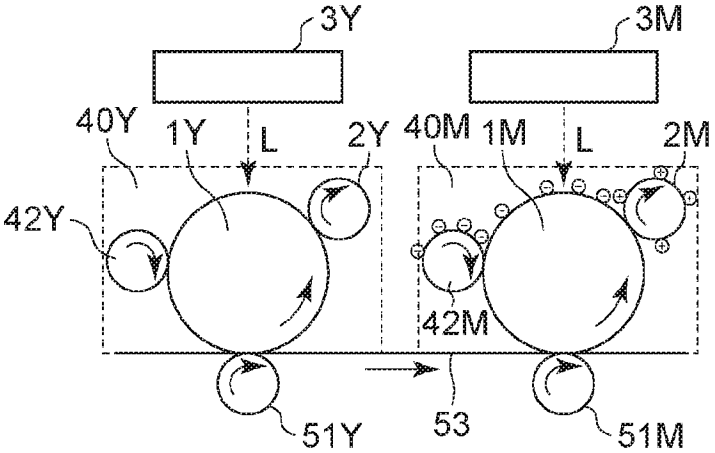

During the image forming operation, a negative charging bias is applied to the charging roller 2M and the retransferred toner 90Y has a positive polarity. Therefore, as illustrated in FIG. 3B, the toner 90Y retransferred on the photosensitive drum 1M is electrically attracted by the charging roller 2M. In this way, even when the full-color image formation is performed, the retransferred toner of an opposite polarity is electrically attached to the charging roller 2, and therefore, the color mixture may be suppressed. However, as illustrated in FIG. 3C, the toner attracted to the charging roller 2M due to the potential difference changes its polarity from the positive polarity to a negative polarity since charge is gradually supplied due to the charging bias applied to the charging roller 2M. If the toner has the negative polarity, the toner of the negative polarity repels the charging bias applied to the charging roller 2M, and therefore, the retransferred toner is gradually transferred onto the photosensitive drum 1M. Consequently, the retransferred toner of a different color is collected by the developing device 4 simultaneously with the image formation as illustrated in FIG. 3D, and accordingly, it is likely that color variation occurs due to color mixture. Furthermore, if the image formation is continued in a state in which the toner is attached to the charging roller 2, the retransferred toner is gradually accumulated, and therefore, charge interruption occurs. As a result, the surface of the photosensitive drum 1 may not be uniformly charged in a predetermined potential and an adverse effect occurs in an image due to charging failure.

3. Charging Roller Cleaning

The toner attached to the charging roller 2 is required to be temporarily cleaned off at a predetermined timing so that the adverse effect in an image is suppressed. Therefore, a cleaning operation of returning the toner collected by the charging roller 2 to the photosensitive drum 1 and cleaning the charging roller 2 is performed. Bu executing the cleaning operation, the retransferred toner on the charging roller 2 is moved from the photosensitive drum 1 onto the intermediate transfer belt 53 and collected by the belt cleaning member 73. Accordingly, the charging failure is suppressed while the color mixture is avoided. A timing when the cleaning is executed will be described hereinafter.

Figure 4:
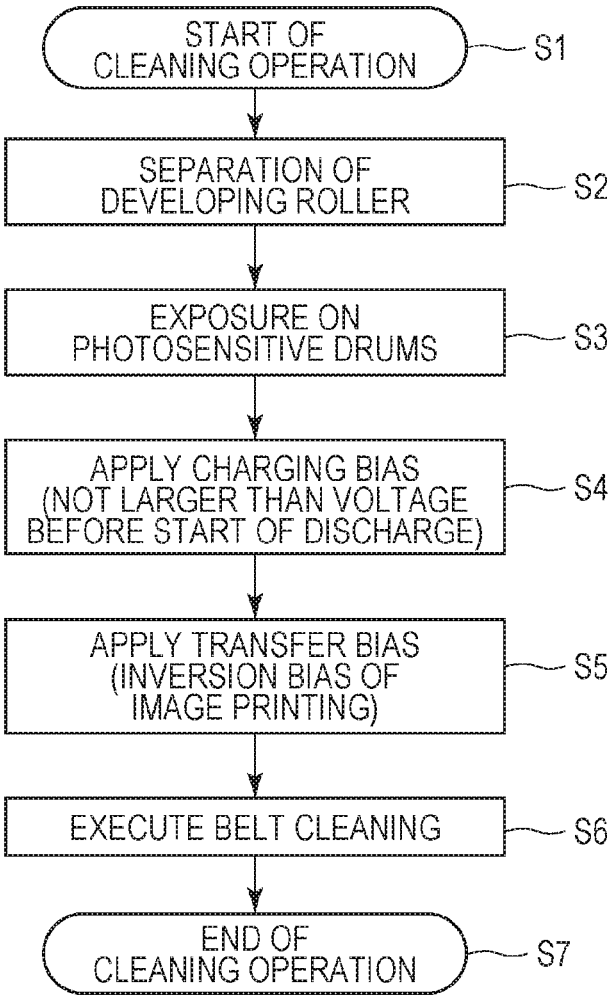
FIG. 4 is a flowchart of a cleaning operation according to the first embodiment.

The cleaning operation according to this embodiment will be described with reference to a flowchart of FIG. 4.

At a timing when the cleaning is executed (S1), first, a developing contact separation cam serving as a contact/separation mechanism, not illustrated, is rotated so that the developing roller 42 is separated from the photosensitive drum 1. In this way, preparation for the cleaning operation is performed (S2). The exposure device 3 performs exposure so that charge on the surface of the photosensitive drum 1 is removed (S3). The pre-charge exposure device 7 may be used for the exposure. After the exposure on the photosensitive drum 1 is completed by at least a single rotation of the photosensitive drum 1, a charging bias is applied (S4). The charging bias applied at this time is equal to or lower than a voltage before start of discharge so that discharge with the photosensitive drum 1 is not performed. Then the toner on the charging roller 2 is electrically moved onto the photosensitive drum 1. After the applying of the charging bias is completed by at least a single rotation of the charging roller 2 and before the toner moved onto the photosensitive drum 1 reaches the contact portion between the photosensitive drum 1 and the primary-transfer roller 51, a transfer bias is applied (S5). At this time, the transfer bias has an inverted polarity relative to a transfer bias applied during the image formation. Accordingly, the toner to be cleaned is moved to the intermediate transfer belt 53 and is collected by the belt cleaning member 73 (S6). The cleaning operation is thus terminated (S7). By this series of operations, the toner on the charging roller 2 may be cleaned.

Next, the phenomenon will be described in accordance with a flow of collection of the toner 90 in the cleaning operation with reference to FIGS. 5A to 5C.

Figure 5A:
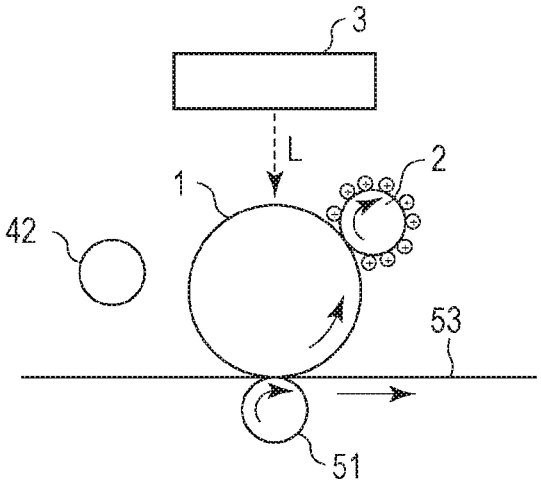
FIGS. 5A to 5C are diagrams illustrating a charging roller cleaning method according to the first embodiment.
Figure 5B:
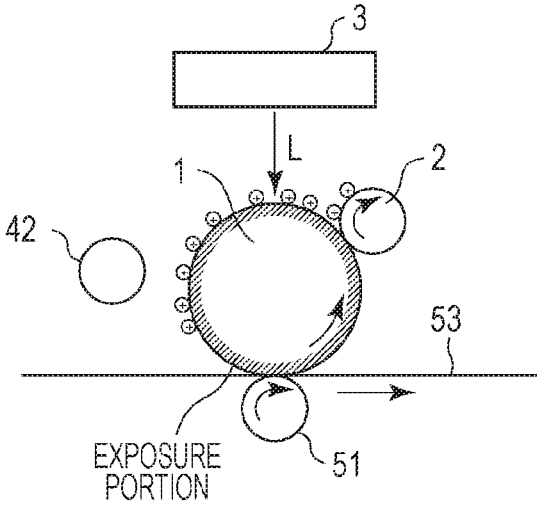
Figure 5C:
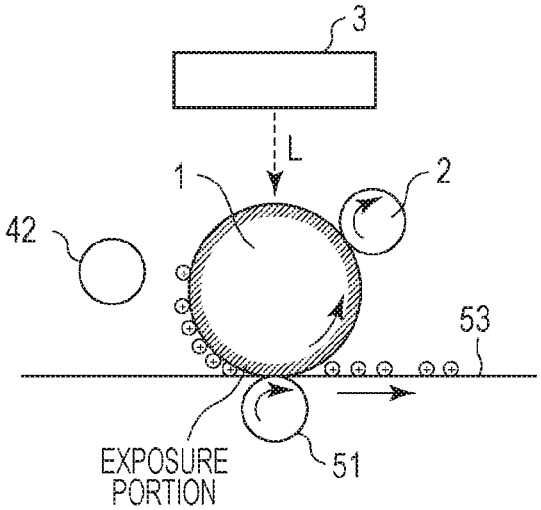

First, after the image forming operation is terminated by forming a toner image on the intermediate transfer belt 53 and collecting a primary-transfer remaining toner by the developing roller 42, the developing roller 42 is separated from the photosensitive drum 1 as illustrated in FIG. 5A. This operation is performed so that a toner returned to the photosensitive drum 1 from the charging roller 2 is not collected by the developing roller 42. Subsequently, as illustrated in FIG. 5B, a charging bias of −1100 V applied during the image formation is switched to a charging bias of +200 V so that a toner of an opposite polarity is moved onto the photosensitive drum 1 from the charging roller 2, and thereafter, a retransferred toner on the charging roller 2 is transferred onto the photosensitive drum 1. Before the charging bias is switched, a surface potential of the photosensitive drum 1 of approximately 0 V is preferably realized by exposing the surface of the photosensitive drum 1 by the exposure device 3 in advance. Here, the exposure to the photosensitive drum 1 may be performed by the pre-charge exposure device 7. As described above, the toner on the photosensitive drum 1 has a polarity of an applied bias due to discharge between the charging roller 2 and the photosensitive drum 1. However, charge of the toner on the charging roller 2 is moved to the photosensitive drum 1 due to the discharge, and therefore, the toner attached on the charging roller 2 has a polarity opposite to that of the applied bias. Accordingly, in a case where the surface potential of the photosensitive drum 1 is as high as a potential in the image formation, the polarity of the toner on the charging roller 2 becomes a normal polarity since reverse discharge is performed between the photosensitive drum 1 and the charging roller 2 immediately after the charging bias is switched. Since the opposite polarity which has maintained by the toner is changed to the normal polarity due to the discharge, the toner may not be transferred on the photosensitive drum 1, and accordingly, an appropriate cleaning operation may not be performed. Therefore, the surface potential of the photosensitive drum 1 is set to 0 V in advance and the charging bias is set lower than a discharge start voltage in an absolute value so that discharge is not performed, changing to the normal polarity of the toner on the charging roller 2 is suppressed, and the cleaning is efficiently performed on the charging roller 2. Note that the surface potential of the photosensitive drum 1 obtained after the exposure is not limited to 0 V as long as the potential relationship does not cause discharge. An entire circumference of the charging roller 2 is cleaned by rotating the charging roller 2 by at least a single rotation. Next, switching of a transfer bias applied to the primary-transfer roller 51 is performed. As illustrated in FIG. 5C, a transfer bias of +500 V applied in the image formation is switched to a transfer bias of −200 V for the cleaning. By this switch, the toner charged to have the opposite polarity on the photosensitive drum 1 may be electrically moved onto the intermediate transfer belt 53. Thereafter, the toner on the intermediate transfer belt 53 is collected in the waste toner container by the belt cleaning member 73. In this way, since the charging roller 2 is cleaned while the developing roller 42 is separated, color mixture caused when the toner is collected in the developing device 4 may be suppressed, and cleaning may be appropriately performed by collecting the toner in the belt cleaning member 73 as a waste toner.

The toner of the opposite polarity attached to the charging roller 2 is transferred on the photosensitive drum 1 due to a potential difference between the photosensitive drum 1 and the charging roller 2, is transferred onto the intermediate transfer belt 53, and is collected by the belt cleaning member 73 on the intermediate transfer belt 53 in the cleaning operation described above.

The cleaning operation is executed in a case where a retransferred toner of an opposite polarity is electrically attached to the charging roller 2 and the toner is to be collected by the belt cleaning member 73. Accordingly, the cleaning operation is not performed on the process cartridge 40 disposed on the uppermost stream of the intermediate transfer belt 53. Since the belt cleaning member 73 is disposed on an upper stream relative to the process cartridge 40 disposed on the uppermost stream of the intermediate transfer belt 53, the secondary-transfer remaining toner may be collected. Since such a process cartridge 40 is disposed on the uppermost stream, retransfer is not performed in the first place. Accordingly, a toner of another color does not intermediate in the primary-transfer position of the process cartridge 40 disposed on the uppermost stream of the intermediate transfer belt 53, and therefore, the color variation caused by the color mixture does not occur.

The charging bias, the transfer bias, and an execution time of the cleaning according to this embodiment are not limited to these.

Next, a timing when the cleaning operation is executed in the image forming operation will be described.

In this embodiment, the cleaning operation is performed after the image forming operation is terminated. The image formation may be continued without deteriorating image quality and functions if a toner on the charging roller 2 is cleaned every time the image formation is terminated. The cleaning operation is preferably performed after the image formation is terminated so as not to increase a downtime in the image formation.

On the other hand, in a case where jobs are consecutively transmitted, during the image formation, a toner of an opposite polarity is continuously collected by the charging roller 2 without transferring the toner from the charging roller 2 to the photosensitive drum 1 until the cleaning operation is performed after the image formation is terminated. In a case where the image formation is consecutively performed, it is preferable that the cleaning operation is performed as less as possible so that the downtime is reduced. Therefore, the toner of the opposite polarity is required to be maintained on the charging roller 2 during the image formation. However, while a printing operation is consecutively performed, an amount of attenuation of charge of the toner and an amount of attached toner are increased if the toner of the opposite polarity is repeatedly attached to the charging roller 2 every time the image forming operation is performed. Accordingly, the toner may not be continuously attached to the charging roller 2, and therefore, the image formation may not be appropriately performed.

Therefore, in a case where the number of recording materials on which an image is consecutively formed is large, a threshold value is set and the cleaning operation may be performed in the course of the consecutive image formation. Accordingly, the cleaning operation is not performed after the image forming operation is terminated but performed in the course of the consecutive image formation so that an adverse effect in an image is suppressed. However, it is preferable that the cleaning operation is performed as less as possible during the consecutive image formation in terms of reduction in the downtime.

Figure 6:
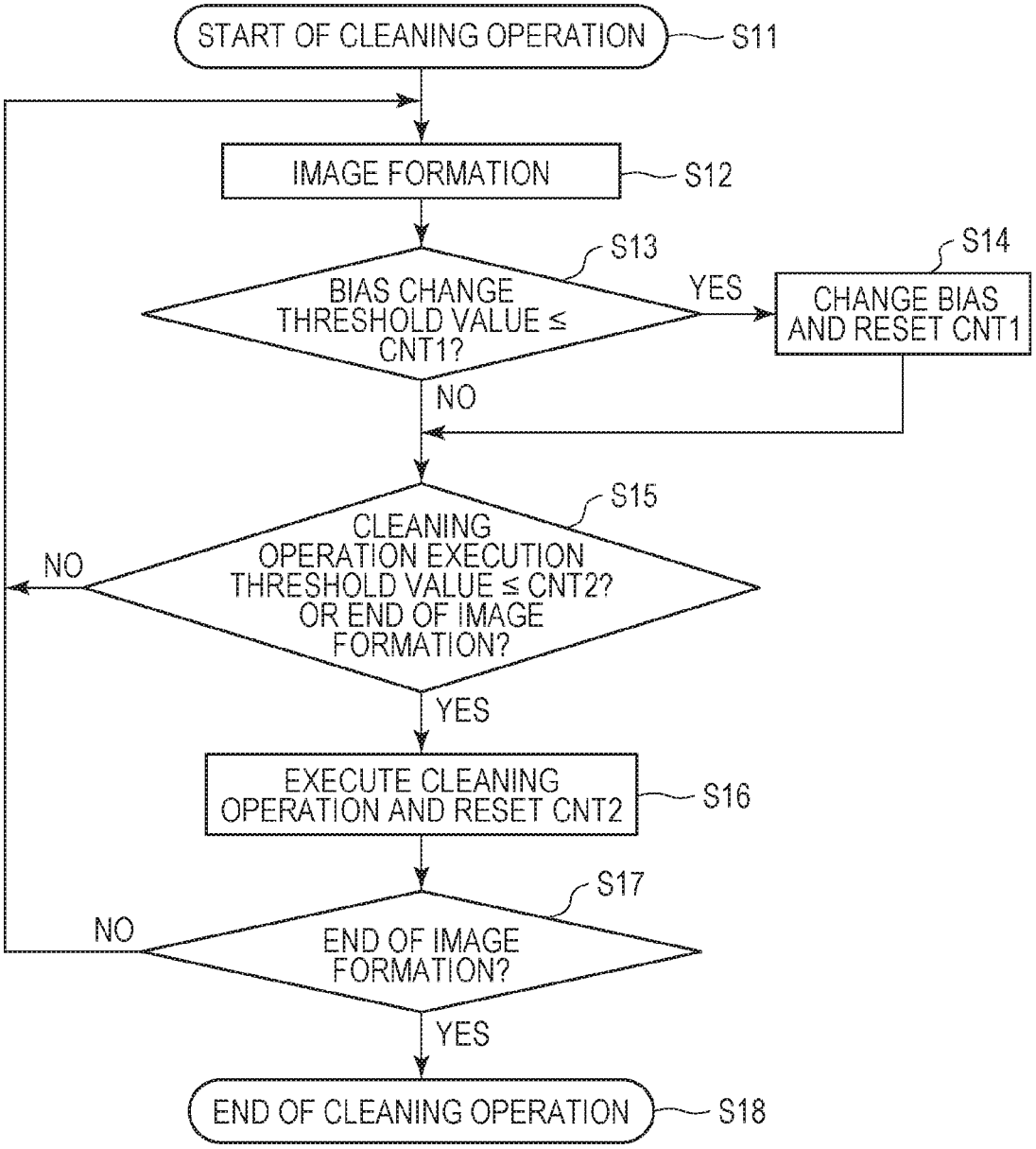
FIG. 6 is a flowchart of an image forming operation and a cleaning operation according to the first embodiment.
Figure 7:
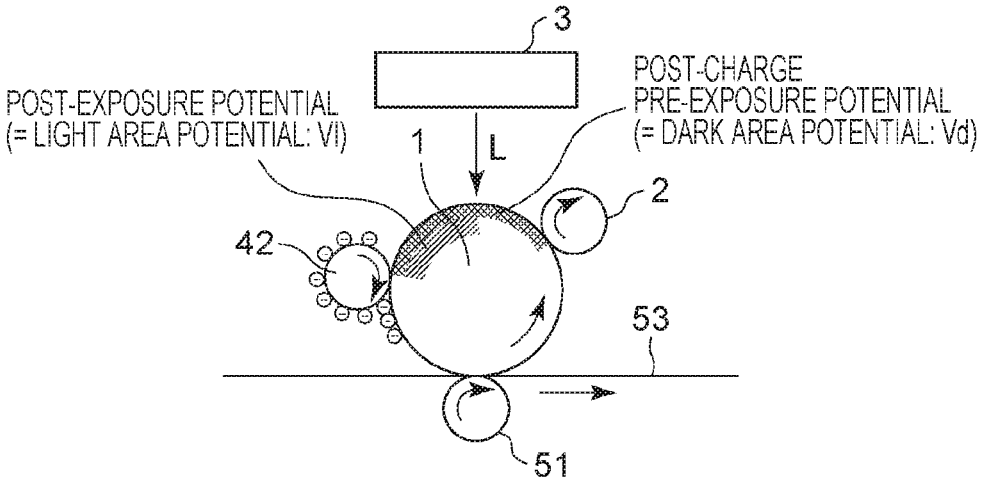
FIG. 7 is a diagram illustrating the positional relationship of potentials according to the first embodiment.

FIG. 6 is a sequence chart of a cleaning operation execution timing while the image forming operation is executed according to this embodiment. The cleaning execution timing will be described in sequence with reference to FIG. 6.

A motor, not illustrated, is driven before start of the image forming operation (S11), and various biases are applied so that the image forming operation is started (S12). During the image forming operation, a bias change counter (CNT1) and a cleaning operation execution counter (CNT2) are started. In this embodiment, when a value of the bias change counter (CNT1) reaches a threshold value, a charging bias is changed and a number of printed sheets are counted. During the image forming operation, it is determined whether a value of the bias change counter (CNT1) has exceeded a bias change threshold value (S13). When the determination is affirmative, a bias to be applied is changed and the bias change counter (CNT1) is reset (S14). Similarly, it is determined whether a value of the cleaning operation execution counter (CNT2) has exceeded a cleaning operation execution threshold value or whether the image forming operation is to be terminated (S15). When the determination is affirmative, the image forming operation is terminated, the cleaning operation is executed, and the cleaning operation execution counter (CNT2) is reset (S16). Thereafter, when the image forming operation is to be terminated (S17), the driving of the motor is stopped and the image forming operation is terminated (S18). On the other hand, when the image forming operation is to be continued, the process returns to step S12 where the image formation is continuously performed.

Note that, as described below, any of parameters which affect the toner on the charging roller 2, such as an amount of exposure performed by the exposure device 3, a transfer bias, and a pre-charge exposure amount, may be changed as the bias change threshold value. Here, a determination as to whether the cleaning operation is to be executed may be preferably performed in accordance with an amount of toner attached to the charging roller 2. Accordingly, the counted matter may not be the number of copies as long as the counted matter relates to an amount of toner attached to the charging roller 2, such as a rotation speed and a rotation time of the photosensitive drum 1 and a printing ratio of the toner, for example. The amount of toner attached to the charging roller 2 is obtained by experiment in advance and is estimated in accordance with a use environment and a use state of the developing device 4. This is because the amount of toner attached to the charging roller 2 mainly depends on an amount of retransferred toner and the amount of retransferred toner depends on the use environment and the use state of the developing device 4. In a case where an amount of remaining toner in the developing device 4 is small and deterioration of the toner is accelerated, for example, an amount of retransferred toner is increased. Therefore, control is performed such that the number of copies before the cleaning is executed is reduced.

4. Bias Control in Sheet Interval

This embodiment is characterized in that normal polarization of a toner is suppressed by changing the charging bias in a period of time in which the image forming operation is not performed during the consecutive image formation.

Note that a term "sheet interval" indicates an interval time between an image forming period and a next image forming period. In the image forming period, a toner image for forming an image to be transferred to the sheet P in a transfer nip portion serving as a contact portion between the secondary transfer unit 52 and the intermediate transfer belt 53 is formed on the photosensitive drum 1. Specifically, the sheet interval indicates an interval between a time when first transfer of a trailing end of an image for one sheet P on the photosensitive drum 1 is completed and a time when image formation of a leading end for a next sheet P is started. Here, in a case where the image formation is successively performed on the intermediate transfer belt 53, for example, although timings of the image formation are shifted among the different stations, the sheet interval is defined between a time when primary transfer of one of the stations on a lowermost stream is terminated and a time when image formation is started in another one of the stations disposed on an uppermost stream. Note that the term "interval time" is defined to be the same as the term "sheet interval" described above.

The toner held on the charging roller 2 is polarized in an opposite manner by discharge. On the other hand, the toner is gradually polarized in a normal polarity due to triboelectric charging with the photoconductive drum 1.

Therefore, in this embodiment, the charging bias is increased in a sheet interval which is an interval time so that the normal polarization of the toner held on the charging roller 2 is suppressed. In this way, opposite polarization on the charging roller 2 is further enhanced. However, if the charging bias is increased, a discharge amount is also increased, and therefore, the photosensitive drum 1 is further damaged. Consequently, scraping and deterioration of the photosensitive drum 1 are enhanced. Accordingly, in this embodiment, an amount of the change of the charging bias is determined in accordance with the number of copies to be consecutively printed so that a discharge amount is reduced as much as possible. Specifically, in an early stage of the image formation during consecutive printing, an amount of toner is small on the charging roller 2 and an opposite polarity is maintained in the toner on the charging roller 2, and therefore, it is set that an excessively large amount of discharge is not required. On the other hand, from a middle stage to a late stage of the image formation during the consecutive printing, attenuation of the charge of the toner of the opposite polarity on the charging roller 2 is enhanced and an amount of the toner of the opposite polarity is increased, and therefore, a charging bias for enhancing discharge when compared with the early stage is set.

Hereinafter, the bias control in the sheet interval when printing is consecutively performed and the relationship between maintaining of the toner on the charging roller 2 and color mixture will be described.

The adverse effect in an image caused when image formation is consecutively performed in a state in which the toner of the opposite polarity is held on the charging roller 2 until the cleaning operation is executed is discussed. Specifically, an operation of consecutively forming images of a printing ratio of 5% on 100 sheets by the yellow cartridge 40Y is performed 200 times. In this state, a level of color mixture of the cyan cartridge 40C and a level of an adverse effect in the images due to discharge (vertical streaks caused by scraping of the drum and degradation of density) are evaluated in the images. As the level of color mixture, "○" indicates that there are not any problems in an image" and "x" indicates that color change is not allowable. As the level of the adverse effect in an image due to discharge, "○" indicates that there are not any problems in an image and "x" indicates that an adverse effect in an image is not allowable. In this embodiment, a case where the yellow toner 90Y is mixed with the cyan toner 90C which is a combination which appears a significant color change is taken as an example for the discussion.

In a first comparative example, a charging bias of −1100 V is applied to the charging roller 2 when the image formation is performed. A surface potential of the photosensitive drum 1 obtained immediately after charging which is a post-charge pre-exposure potential is controlled to be approximately −550 V. Furthermore, a developing bias of −400 V is applied to the developing roller 42 and a transfer bias of +500 V is applied to the primary-transfer roller 51. A potential of an image portion on the photosensitive drum 1 is maintained to be approximately −140 V under control of the exposure device 3. The pre-charge exposure device 7 performs pre-charge exposure on the surface of the photosensitive drum 1 which has passed the contact portion which is contact with the primary-transfer roller 51, and the surface potential of the photosensitive drum 1 is temporarily set to approximately 0 V. In the consecutive image formation in which jobs are consecutively transmitted, the image forming operation is continuously performed in a state in which the biases are maintained. In the sheet interval, the secondary transfer unit 52 is separated from the photosensitive drum 1, and conditions of the biases are the same as those in the image formation. After the consecutive image forming operation on 100 sheets is terminated, the cleaning operation is executed. This operation is repeatedly performed 200 times. The image forming apparatus 100 includes a counter for counting the number of consecutive printed sheets, not illustrated, and the counter is incremented from the start of the image forming operation.

A result of a first comparative example will be described with reference to Table 1. In Table 1, levels of adverse effects in an image caused by color mixture and discharge obtained when the image formation is consecutively performed while the bias relationship between the sheet interval and the consecutive image formation is maintained are illustrated. As a result of Table 1, color mixture occurs in conditions of the first comparative example but an adverse effect in an image due to discharge does not occur. The reason that the color mixture occurs in the first comparative example is considered as follows: The image formation is consecutively performed under a fixed condition of a potential difference between the charging bias and the surface potential of the photosensitive drum 1, and therefore, it is electrically more difficult to hold a toner of an opposite polarity on the charging roller 2 as the number of sheets subjected to the image formation becomes larger. The color mixture may occur in the following manner. The yellow cartridge 90Y of an opposite polarity collected by the charging roller 2C of the cyan cartridge 40C is changed to have a normal polarity due to influence of charging and transferred onto the photosensitive drum 1 again, and collected by the cyan developing device 4C.

In a second comparative example, an amount of discharge between the charging roller 2 and the photosensitive drum 1 is increased so that occurrence of the color mixture is suppressed. The discharge between the photosensitive drum 1 and the charging roller 2 is required to be enhanced so that a polarity of the toner on the charging roller 2 is not inverted, and therefore, the discharge between the photosensitive drum 1 and the charging roller 2 are actively generated. Then charge applied to the toner on the charging roller 2 is moved to the photosensitive drum 1 so that the positive polarity of the collected toner on the charging roller 2 is enhanced. The movement of the charge is enhanced as the discharge becomes larger, and therefore, the positive polarity of the toner on the charging roller 2 is maintained. An amount of charge moved from the toner on the charging roller 2 to the photosensitive drum 1 is changed due to intensity of discharge, and therefore, the potential difference between the charging bias and the surface potential of the photosensitive drum 1 which controls the intensity of the discharge affects the polarity of the toner on the charging roller 2. When the potential difference is increased, the discharge is enhanced and the toner of the positive polarity is maintained. However, when the potential difference is reduced, an amount of the discharge is reduced and charge is applied to the toner due to the charging bias, and therefore, the positive polarity may not be maintained. Therefore, the potential difference between the charging roller charging roller 2 and the surface potential of the photosensitive drum 1 is preferably set large so that the toner of the opposite polarity is maintained on the charging roller 2.

As conditions of the second comparative example, a charging bias of −1100 V is applied similarly to the first comparative example during the consecutive image formation, and a charging bias of −1200 V which is higher than that in the first comparative example is applied to the charging roller 2 in the sheet interval. Therefore, the surface of the photosensitive drum 1 is charged to have a post-charge pre-exposure potential of approximately −650 V in the sheet interval. Furthermore, the surface potential of the photosensitive drum 1 after the primary transfer is controlled to be approximately 0 V by pre-charge exposure performed by the pre-charge exposure device 7 so that the surface potential becomes equal to that in the first comparative example. Specifically, an amount of discharge which occurs between the charging roller 2 and the photosensitive drum 1 is larger than that in the first comparative example by influence of the discharge in the sheet interval. Furthermore, predetermined amounts of a transfer remaining toner and a retransferred toner are appropriately set. The developing bias and the exposure amount are the same as those of the first comparative example.

A result of the second comparative example is compared with that of the first comparative example with reference to Table 1. Under the conditions of the second comparative example, although the color mixture is not generated and improvement tendency is shown when compared with the first comparative example, an adverse effect in an image occurs due to discharge. This is because, although a discharge amount is increased and a level of the color mixture is improved in accordance with the increase in the charging bias, influence of the discharge leads to the adverse effect in an image. The discharge is required to be enhanced between the charging roller 2 and the photosensitive drum 1 so that the charge of the toner on the charging roller 2 is maintained, and therefore, the charging bias is increased in the sheet interval in the second comparative example. However, the photosensitive drum 1 is consequently damaged due to the discharge. It is said that the increase in the potential difference which leads to increase in discharge causes vertical streaks caused by scraping of the photosensitive drum 1 due to the discharge and lowering of density caused by deterioration of discharge of the photosensitive drum 1.

Figure 8:
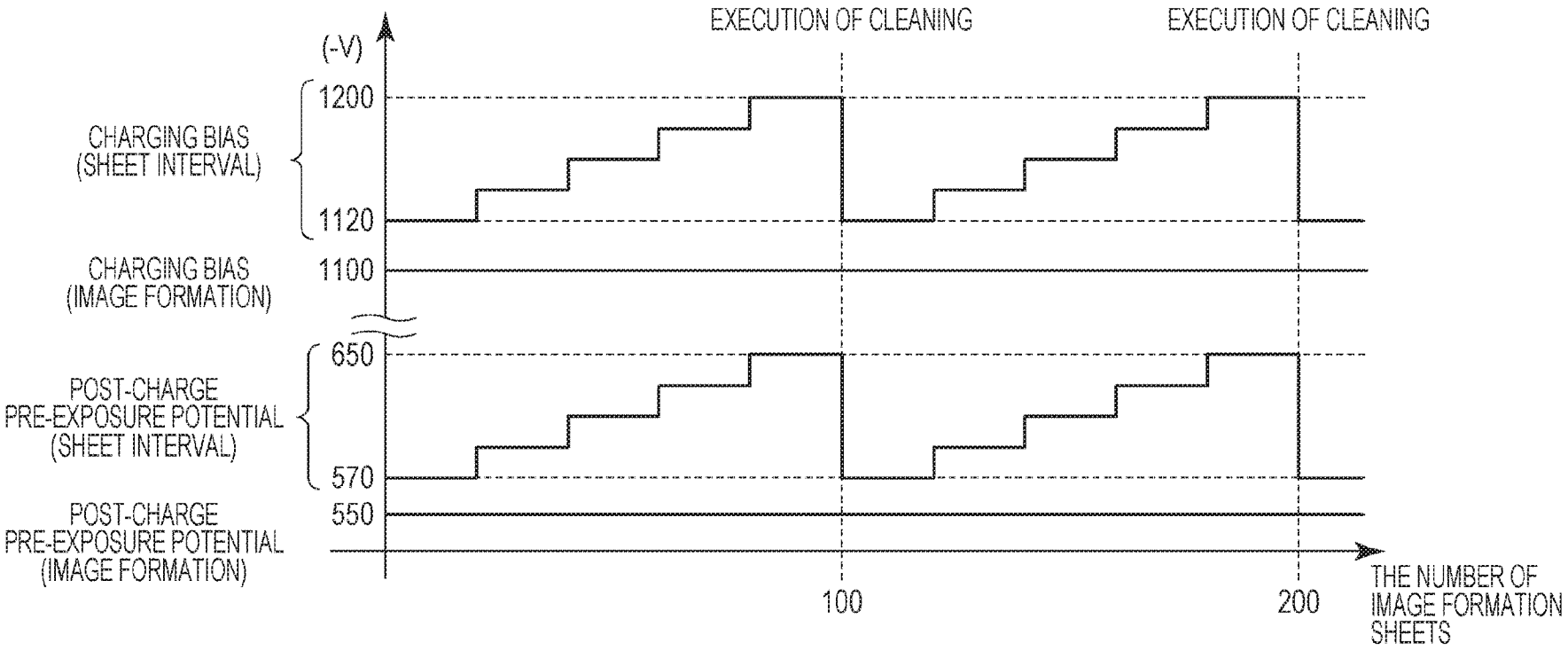
FIG. 8 is a diagram illustrating the relationship between a bias and a potential according to the first embodiment.

To suppress occurrence of such a phenomenon, a bias in the sheet interval is controlled as below in the first embodiment. FIG. 8 is a diagram illustrating bias changes in the sheet interval and in the image forming operation for the each numbers of sheets subjected to the image formation. In FIG. 8, the relationship between a number of sheets subjected to the image formation (100 sheets×2 cleaning operations=200 sheets) in an axis of abscissae and a bias in an axis of ordinates are illustrated. In the first embodiment, the charging bias in the sheet interval is changed by −20 V every 20 sheets subjected to the image formation. In this way, the potential difference between the photosensitive drum 1 and the charging roller 2 is gradually increased by gradually increasing an absolute value of the charging bias in the sheet interval in accordance with the number of sheets subjected to the image formation. Therefore, a discharge amount is increased in a second half of the consecutive image formation, and accordingly, the polarity of the toner on the charging roller 2 is effectively maintained by the discharge. Note that the charging bias of −1100 V during the image forming operation and the post-charge pre-exposure potential of the photosensitive drum 1 of −550 V are not changed. This does not affect the image formation. Furthermore, an amount of transfer remaining toner and an amount of retransferred toner are controlled by the transfer bias, and the pre-charge exposure device 7 controls the surface potential of the photosensitive drum 1 to approximately 0 V after the primary transfer.

It is assumed that, when the consecutive image forming operation is performed while the charging bias in the sheet interval is increased in accordance with the number of sheets subjected to the image formation, a charging bias for the image formation in an interval between a first sheet and a second sheet immediately after start of the image formation is −1120 V. Accordingly, the charging bias of −1120 V is larger than the charging bias of −1100 V during the image forming operation by an absolute value of 20 V. A post-charge pre-exposure potential of the photosensitive drum 1 in the sheet interval at this time is −570 V. Thereafter, control is performed such that the charging bias in the sheet interval is increased by an absolute value for every 20 sheets subjected to the image formation as illustrated in FIG. 8. For example, a charging bias applied in an interval between a 99-th sheet and a 100-th sheet of the image formation is −1200 V. The cleaning operation is performed after the consecutive image formation is terminated, the charging bias is returned to −1120 V which has obtained when the image forming operation is started, and the printing operation is restarted. As with the first and second comparative examples, this operation is repeatedly performed 100 times in consecutive manner, and the consecutive operation is further performed 200 times. A result will be illustrated in Table 1.

TABLE 1

| Image Evaluation | Color Variation due to Color Mixture | Adverse Effect in Image due to Discharge |
|---|---|---|
| Comparative Example 1 | x | ○ |
| Comparative Example 2 | ○ | x |
| Embodiment 1 | ○ | ○ |

Although the color variation occurs due to color mixture in the first comparative example and the adverse effect occurs due to discharge in the second comparative example, the color variation and the adverse effect do not occur and an excellent image is obtained in the first embodiment. This result is seen to be led by an effect of a change of the charging bias in the sheet interval in accordance with the number of sheets subjected to the image formation. The color variation due to the color mixture is seen to be improved since the opposite polarity of the yellow toner 90Y on the charging roller 2C may be maintained since the discharge between the charging roller 2C and the photosensitive drum 1C is enhanced from a middle stage to a late stage of the consecutive image formation. Furthermore, the adverse effect in an image caused by discharge is not seen to occur since an entire discharge amount may be suppressed by suppressing the discharge in an early stage of the consecutive image formation and gradually increasing the discharge in a period from the middle stage to the late stage of the consecutive image formation which requires the discharge. In the early stage of the consecutive image formation, a chance of contact between the charging roller 2 and the photosensitive drum 1 is small, and therefore, the opposite polarity of the toner on the charging roller 2 is maintained and a large amount of discharge is not required. However, in the period from the middle stage to the late stage of the consecutive image formation, the number of times the charging roller 2 and the photosensitive drum 1 are in contact with each other is increased and an amount of toner of the opposite polarity on the charging roller 2 is increased, and therefore, a larger amount of discharge is required. Accordingly, the bias control described in the first embodiment is effective to suppress the color variation caused by the color mixture and the adverse effect in an image caused by the discharge. As described above, the maintaining of the retransferred toner on the charging roller 2 and the suppressing of the adverse effect in an image caused by the discharge in the photosensitive drum 1 may be attained by appropriately controlling an amount of discharge during the consecutive image formation.

An excellent image may be output in the cleanerless system by controlling the charging bias as described below. Before cleaning, periods in which the image forming operation is executed to consecutively form toner images on first to third recording materials in this order are determined as first to third image forming periods, respectively. Furthermore, a period corresponding to a sheet interval between the first and second image forming periods in which the image forming operation is not executed is referred to as a first interval time, and a period corresponding to an interval between the second and third image forming periods is referred to as a second interval time. Control is performed such that, in the first and second interval times, a charging bias of a polarity the same as a charging bias in the image forming periods is applied, and an absolute value of the charging bias in the second interval time is larger than that of the charging bias in the first interval time. In this case, discharge is more enhanced in the certain period when compared with the discharge between the charging roller 2 and the photosensitive drum 1 performed when the image forming operation is started in accordance with increase in the number of sheets subjected to the image formation. The period in which discharge is enhanced in accordance with the increase in the number of sheets subjected to printing may be a portion of interval times executed a plurality of times during the consecutive printing operation or discharge may be gradually increased in interval times executed a plurality of times during the consecutive printing operation as described in the first embodiment. The polarity of the toner on the charging roller 2 may be maintained by enhancing the discharge as described above, and therefore, the color mixture may be suppressed. Furthermore, the discharge in the consecutive printing operations may be suppressed as much as possible by increasing an amount of discharge in the interval time from a middle stage to a late stage of the consecutive printing operations relative to an interval time in an early stage in the consecutive printing operation, and therefore, the adverse effect may be suppressed. The normal polarization of the retransferred toner caused by the charge is not actively performed since an amount of charge of the toner of the opposite polarity on the charging roller 2 is large when the number of sheets subjected to the image formation is small. On the other hand, the opposite polarity of the toner is shifted to the normal polarity in the late stage in which the number of sheets subjected to the image formation is increased and an amount of charge of the toner is reduced. Therefore, it is particularly preferable that the amount of discharge is suppressed in the early stage and the amount of discharge is increased in the later stage. Specifically, an absolute value of the charging bias applied in the first interval time in the consecutive printing operations is preferably controlled to be smaller than an absolute value of the charging bias applied in a last interval time in the consecutive printing operations. Then the charging bias applied in an interval time immediately before the cleaning is changed to a charging bias applied in an interval time immediately after the cleaning after the cleaning. Under this condition, if the image forming operation is started again, an amount of discharge may be suppressed in an early stage and an amount of discharge may be gradually increased in a later stage. Furthermore, in a case where the image formation is consecutively executed before the cleaning, an absolute value of the charging bias applied in the interval times is gradually increased as a cleaning period is to be reached, and therefore, discharge may be gradually enhanced.

Furthermore, although the developing roller 42 is separated from the photosensitive drum 1 in the sheet interval according to this embodiment, the sheet interval may be entered in a state in which the developing roller 42 is in contact with the photosensitive drum 1 if the sheet interval is small, and therefore, a contact/separation operation is not completed before a next image forming operation is started. When the photosensitive drum 1 is rotated in a state in which the developing roller 42 is in contact with the photosensitive drum 1, bias control is required to be performed similarly to the image forming operation. When the charging bias is increased in the sheet interval, the potential difference between the charging bias and the developing bias is also changed, and therefore, the developing bias is simultaneously changed by −20 V. A potential difference between a dark area potential (Vd) of the photosensitive drum 1 and the developing bias is controlled in a fixed manner in a contact portion between the developing roller 42 and the photosensitive drum 1 so that the potential difference of approximately 150 V is maintained by increasing the absolute value of the charging bias and the absolute value of the developing bias. Accordingly, occurrence of fog which is a phenomenon in which the toner is developed in the dark portion in the sheet interval may be suppressed. The developing bias is appropriately set to a certain degree so that fog does not occur.

As described above, discharge in the interval time in the consecutive image forming operation is gradually enhanced by controlling the charging bias, the color mixture caused by the retransferred toner is efficiently suppressed, and the adverse effect in an image due to the discharge may be suppressed. Accordingly, a timing when the cleaning operation is executed in the consecutive image formation may be delayed by suppressing the above problems, and therefore, the number of times the cleaning operation is performed and the downtime may be reduced.

Although the charging bias in the sheet interval in this embodiment is changed in a step-by-step manner every 20 sheets of image formation in this embodiment, the threshold value may be appropriately changed. The threshold value may correspond to a rotation speed of the photosensitive drum 1 or an accumulated printing ratio, instead of the number of copies. Furthermore, although the charging bias in the sheet interval is changed by monotone increase in this embodiment, the charging bias may be increased to be larger than the charging bias obtained when the image forming operation is started during the consecutive image formation. Specifically, if the discharge amount is increased at a certain point, the discharge amount may be reduced or fixed in the course of the consecutive image formation depending on balance between the color mixture and the discharge.

Similarly, although the cleaning operation is executed in an interrupting manner in the consecutive image formation at a timing when the image formation is consecutively performed for 100 sheets in this embodiment, a threshold value may be a rotation speed of the photosensitive drum 1 or an accumulation value of the printing ratio instead of the number of copies.

Furthermore, although the cleaning operation is performed after the image forming operation is terminated in this embodiment, the cleaning operation may not be performed even after the image formation is terminated as long as the image forming operation may be continued while the toner is held on the charging roller 2. Examples of such a case include a case where an interval between jobs is short and a charge of the toner on the charging roller 2 is not significantly attenuated, and the toner may be held on the charging roller 2 as it is or a case where the printing ratio is low and an amount of toner of an opposite polarity is small on the charging roller 2. Here, assuming that a case where an interval between jobs is large, the operation is not performed in the interval, and therefore, discharge does not occur. Then the charge of the toner attached on the charging roller 2 is attenuated and the opposite polarity is gradually shifted to 0. In this state, even if the charging bias is applied to the charging roller 2 so that the image forming operation is performed again, the toner may not be sufficiently held on the charging roller 2 in an electric manner and the toner is moved to the photosensitive drum 1. On the other hand, if an interval between jobs is short, a force of the charging roller 2 for holding the toner is not reduced as much since the image formation is performed while the discharge is enhanced before the interval even when the image forming operation is terminated once. Therefore, the image formation is continuously performed while an amount of discharge is increased.

Accordingly, the number of times the cleaning operation is performed may be reduced after the image forming operation or in the course of the consecutive image formation by performing the control of this embodiment.

In this embodiment, the case where a toner which is charged in a negative polarity is used as a developer has been described. However, a toner charged in a positive polarity may be used. In this case, if the present disclosure is employed, although the bias relationship is reversed between a positive polarity and a negative polarity, that is, a charging bias and a developing bias during the image formation have a positive polarity. However, the relationship is the same as that of the first embodiment when the biases to be applied are seen as absolute values. Also in this case, when the present disclosure is employed, the number of times the cleaning operation is performed may be reduced after the image forming operation is performed or in the course of the consecutive image formation.

Second Embodiment

In the first embodiment, the charging bias is changed in the sheet interval during the consecutive image formation so that the color mixture and an adverse effect in an image caused by the discharge is suppressed. To address the problems described above, discharge between a charging roller 2 and a photosensitive drum 1 is controlled. Accordingly, as with the first embodiment, a discharge amount is changed when a charging bias to be applied to the charging roller 2 is changed. In a second embodiment, a state of the photosensitive drum 1 is changed instead of the charging roller 2. Therefore, an exposure device 3 is used to change a surface potential of the photosensitive drum 1. The exposure device 3 performs normal exposure of an image forming unit so as to form a light area potential (V1) as a post-exposure potential of an image portion in the image portion, and performs weak exposure on the non-image portion so as to form a dark area portion (Vd) as the post-exposure potential of a non-image portion. A post-charge pre-exposure potential (Vdl) which is equal to or larger than the dark area potential (Vd) is temporarily charged by the charging roller 2 to which the charging bias is applied. The exposure device 3 (the post-exposure device) disposed in a position after the charging and before the development relative to a rotation direction of the photosensitive drum 1 weakly emits light to expose the surface of the photosensitive drum 1 so that the surface potential is attenuated (dropped). In this way, a target dark area potential (Vd) may be obtained using the exposure process in addition to the charging process. Furthermore, in this way, the surface potential of the photosensitive drum 1 may be reduced in advance. Furthermore, in the second embodiment, the pre-charge exposure device 7 does not perform the exposure, and the potential of the photosensitive drum 1 is reduced by a transfer bias after the photoconductive drum 1 passes a transfer contact portion. By this, a potential difference becomes larger than a potential difference between the surface potential of the photoconductive drum 1 and the charging roller 2 which is obtained after primary transfer and which is generated by the charging bias by an amount of the exposure, and therefore, an effect of increase in a discharge amount may be expected.

Furthermore, this method contributes to improvement of stability of a potential. The discharge start voltage (Vth) of a DC charging method is changed depending on a photosensitive layer thickness of the photosensitive drum 1, and therefore, the dark area potential (Vd) is increased if the thickness of the photosensitive drum 1 is reduced due to scraping of the photosensitive drum 1. Accordingly, a charging bias to be applied is changed depending on the film thickness of the photosensitive drum 1 so that an appropriate dark area potential (Vd) is obtained, and therefore, a discharge amount varies depending on the film thickness. Specifically, when the film thickness of the photosensitive drum 1 varies, control of the discharge amount becomes difficult, and therefore, it is difficult to attain balance between margins for color mixture and an adverse effect in an image caused by the discharge. Therefore, using information associated with discharge, such as the number of sheets subjected to the image formation, a rotation speed of the photosensitive drum 1, a period of time the charging bias is to be applied, and an exposure amount, the thickness of the photosensitive drum 1 may be calculated, a fixed potential setting may be attained by controlling the exposure amount, and the discharge amount may be controlled.

Therefore, the charging bias and the exposure amount in the sheet interval are controlled in the numbers of sheets subjected to the consecutive image formation so that discharge in the sheet interval during the consecutive image formation is appropriately enhanced. Specifically, as with the first embodiment, discharge is not performed that much in an early stage of the consecutive image formation, and the charging bias and the exposure amount for enhancing the discharge are set in a period from a middle stage to a late stage in the consecutive image formation.

Figure 9:
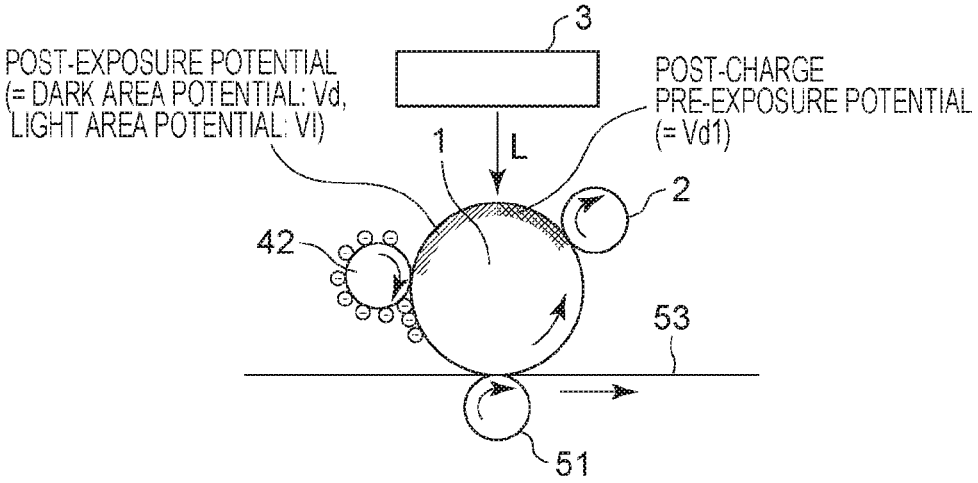
FIG. 9 is a diagram illustrating the positional relationship of potentials according to a second embodiment.
Figure 10:
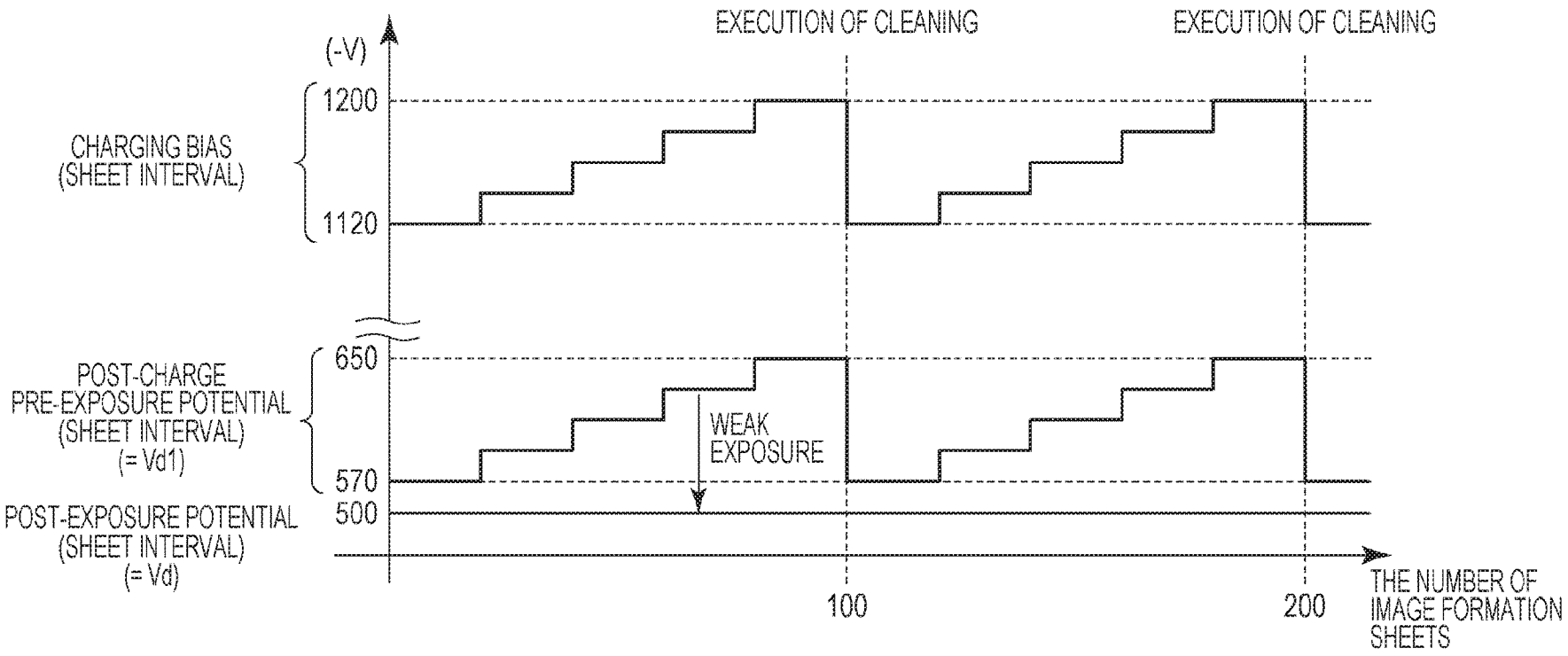
FIG. 10 is a diagram illustrating the relationship between a bias and a potential according to the second embodiment.

According to this embodiment, an exposure amount is controlled as described below. A description of a potential will be made with reference to FIG. 9 in a range from the charging roller 2 to the developing roller 42 in a rotation direction of the photosensitive drum 1 taking a potential state in the image formation as an example. First, when the charging bias is applied to the charging roller 2, a potential is generated on the photosensitive drum 1. The potential at this time is referred to as a post-discharge pre-exposure potential (Vd1). In the second embodiment, the exposure device 3 adjusts the post-charge pre-exposure potential (Vd1) to obtain the dark area potential (Vd) serving as the surface potential of the photosensitive drum 1 in the sheet interval. When weak exposure which is weaker than exposure performed at a time of normal image formation is performed on the photosensitive drum 1, the post-charge pre-exposure potential (Vd1) on the photosensitive drum 1 is changed to the dark area potential (Vd) which is a weak post-exposure potential. Furthermore, as illustrated in FIG. 9, when the image formation is performed, the exposure device 3 performs exposure so that the dark area potential (Vd) in which the toner is not developed and a light area potential (V1) in which the toner is developed are formed. When the normal exposure is performed, the light area potential (V1) which is the post-exposure potential in which the toner is developed is obtained. Biases and exposure amounts for the individual numbers of sheets in the sheet interval during the consecutive printing are illustrated in FIG. 10. FIG. 10 is a diagram illustrating the relationship between the number of sheets denoted by an axis of abscissae and a bias denoted by an axis of ordinates similarly to FIG. 8.

In the second embodiment, a charging bias of −1100 V is applied during the image forming operation. A post-charge pre-exposure potential (Vd1) which is the surface potential of the photosensitive drum 1 immediately after the charge is approximately −550 V. Thereafter, the post-charge pre-exposure potential (Vd1) of the photosensitive drum 1 is subjected to weak exposure of an intensity of 0.030 $\mu J/cm^2$. By this, the dark area potential (Vd) which is a post-weak-exposure potential is approximately −500 V. A developing bias of −350 V is applied to the developing roller 42, and a difference between the developing bias and the dark area potential (Vd) is 150 V similarly to the first embodiment. The light area potential (V1) in the image formation after the adjustment of the exposure amount is approximately −90 V. By this, a difference between the light area potential (V1) and the developing bias is fixed to 260 V, and an image density in the consecutive image formation may be maintained. On the other hand, the charging bias and the exposure amount in the sheet interval is controlled as follows. A charging bias in the sheet interval is changed by −20 V every 20 sheets of the consecutive printing. A charging bias of −1120 V is applied in the sheet interval between first and second sheets which is higher than the charging bias of −1100 V applied during the image forming operation by 20 V in an absolute value. At this time, the surface potential of the photosensitive drum 1 is also changed by −20 V immediately after the charging. Therefore, intensity of the weak exposure in the dark area is increased by 0.002 $\mu J/cm^2$ every 20 copies so that the dark area potential (Vd) is controlled to be fixed in approximately −500 V. By this, the charging bias is increased in an absolute value. However, the dark area potential (Vd) of the photosensitive drum 1 is not changed. Accordingly, a discharge amount between the charging roller 2 and the photosensitive drum 1 is increased in the sheet interval as the number of sheets subjected to the image formation is increased.

A series of the image forming operation and the cleaning operation is repeatedly performed for 100 consecutive printing operations and a series of 100 consecutive printing operations is performed 200 times, and as a result, as with the first embodiment, color mixture and an adverse effect in an image caused by discharge are not generated in the second embodiment. This is because a polarity of a retransferred toner held on the charging roller 2 may be appropriately maintained and an entire discharge amount may be suppressed by increasing a charging bias and an exposure amount in a sheet interval in accordance with the number of sheets subjected to the image formation, and accordingly, both the color mixture and the adverse effect in an image caused by discharge may be suppressed. Color variation caused by color mixture and an adverse effect in an image caused by discharge may be suppressed by controlling a bias and exposure according to the second embodiment.

Accordingly, an excellent image may be output by a cleanerless system by controlling a charging bias and an exposure amount as described below. In a case where consecutive image formation is executed before cleaning, an absolute value of a charging bias to be applied in a sheet interval which is an interval time is controlled to be gradually increased until a cleaning period. Then control is performed such that an amount of exposure to a non-image portion in an interval time in which a charging bias of an absolute value which is relatively larger is applied is larger than an amount of exposure to the non-image portion in an interval time in which a charging bias of an absolute value which is relatively smaller is applied. Furthermore, a potential of the non-image portion of the photosensitive drum 1 in the case where a charging bias of an absolute value which is relatively larger is applied in the interval time is the same as a potential of the non-image portion of the photosensitive drum 1 in a case where a charging bias of an absolute value which is relatively small is applied in the interval time. Accordingly, discharge between the charging roller 2 and the photosensitive drum 1 is more enhanced in a certain period in accordance with increase in the number of sheets subjected to the image formation when compared with the discharge performed in an initial stage after the image forming operation is started. Accordingly, color mixture caused by a retransferred toner may be suppressed and an adverse effect in an image caused by discharge may be suppressed by gradually increasing a discharge amount.

As with the first embodiment, it is particularly preferable that the discharge amount is suppressed in the early stage and the discharge amount is gradually increased toward the later stage. In the second embodiment, the charging bias is controlled similarly to the first embodiment, and in addition, the exposure is controlled as below. Specifically, control is performed such that, in a case where the image formation is consecutively executed after the cleaning, an amount of exposure to a non-image portion in a first interval time is smaller than an amount of exposure on the non-image portion in a last interval time immediately before the cleaning period. Then an amount of exposure on the photosensitive drum 1 performed by the exposure device 3 in an interval time in a case where the image formation is consecutively performed immediately before the cleaning is changed to an amount of exposure in an interval time immediately after the cleaning after the cleaning. Under this condition, if printing operation is started again, a discharge amount may be suppressed in the early stage and a discharge amount may be gradually increased toward the later stage. Furthermore, the discharge may be gradually enhanced by gradually increasing an amount of exposure to the non-image portion in an interval time toward the cleaning period.

Although the discharge amount is increased by fixing the dark area potential (Vd) which is the post-exposure potential by changing the charging bias as illustrated in FIG. 10 in the second embodiment, the dark area potential (Vd) may be changed with a change in the charging bias. Specifically, the discharge amount may be gradually increased by performing control such that the exposure amount is increased as an absolute value of the charging bias applied in the sheet interval is increased. Furthermore, although the pre-charge exposure device 7 does not perform exposure in the second embodiment, exposure performed by the pre-charge exposure device 7 may be combined since the discharge is enhanced by a change of the charging bias.

As described above, by controlling the charging bias and the exposure amount, the discharge may be gradually enhanced in the consecutive image formation, the color mixture caused by the retransferred toner may be efficiently suppressed, and an adverse effect in an image caused by the discharge may be suppressed. Therefore, since a cleaning operation execution timing in the consecutive image formation may be delayed by suppressing the problems as described above, the number of times cleaning is performed and a downtime may be reduced.

Furthermore, the number of restrictions of the apparatus in the second embodiment is smaller than that in the first embodiment. Specifically, since the weak exposure is used, the surface of the photosensitive drum 1 may be charged in a fixed dark area potential (Vd) irrespective of a film thickness of the photosensitive drum 1, and accordingly, the weak exposure is effective in terms of measures, such as sharing of a high-voltage power source. Accordingly, as described in a third embodiment below, even in a case where a high-voltage power source is shared by a plurality of colors and different photosensitive drums 1 of different film thicknesses are employed, a dark area potential (Vd) may be fixed by controlling an exposure amount for each station. In this way, a potential in the sheet interval may be appropriately controlled and this is effective in this embodiment. Furthermore, image density, a line width, and gradation may be stably reproduced by changing a range of a maximum amount of light which forms the light area potential (V1) and a range of a minimum amount of light which forms the dark area potential (Vd) in accordance with a film thickness of the photosensitive drum 1 and independently from the charging bias even in the image formation.

Third Embodiment

In the third embodiment, in a case where a plurality of process cartridges are employed and outputs of charging bias power sources which supply charging biases to be applied to individual charging rollers 2 are fixed, an exposure device 3 controls individual amounts of weak exposure. By this, miniaturization of an apparatus and low cost for fabrication of an apparatus are realized.

In this case, a potential on a photosensitive drum 1 in a sheet interval generated by weak exposure is changed for each number of sheets subjected to consecutive image formation so that a discharge amount between the charging roller 2 and the photosensitive drum 1 is changed. In this case, as with the second embodiment, a pre-charge exposure device 7 does not perform exposure. Accordingly, a surface potential of the photosensitive drum 1 which has passed a transfer contact portion varies depending on a potential after the weak exposure, and a discharge amount is increased as a post-weak-exposure potential becomes smaller in an absolute value. Therefore, even in a state in which a charging bias is fixed, a polarity of a toner held on the charging roller 2 may be maintained by controlling an amount of weak exposure.

Figure 11:
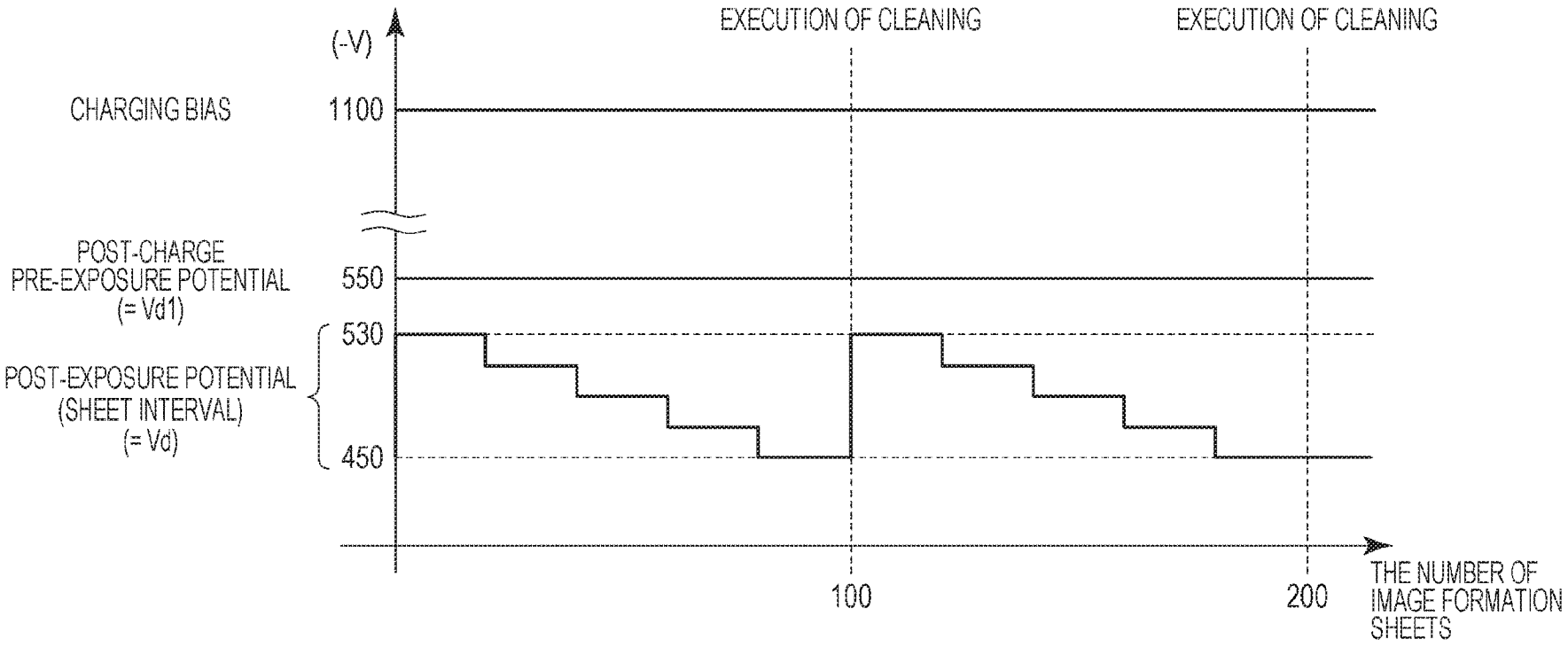
FIG. 11 is a diagram illustrating the relationship between a bias and a potential according to a third embodiment.

In the third embodiment, the charging bias is constantly fixed in a consecutive image forming operation and an exposure amount is controlled as below. A bias and an exposure amount for each number of sheets in the sheet interval are illustrated in FIG. 11. As with FIGS. 8 and 10, FIG. 11 is a diagram illustrating the relationship between the number of sheets subjected to the image formation denoted by an axis of abscissae and a bias denoted by an axis of ordinates.

In the third embodiment, a charging bias of −1100 V is applied when an image forming operation is started. A post-charge pre-exposure potential of the photosensitive drum 1 at this time is approximately −550 V. During the image formation, weak exposure is not performed from beginning to end but the potential of approximately −550 V is used as the dark area potential (Vd1=Vd) and the image forming operation is performed. A developing bias of −400 V is applied to the developing roller 42, and a potential difference between the developing bias and the dark area potential (Vd) is 150 V. As control of the light area potential (V1), a light amount is controlled to be fixed so that the light area potential (V1) becomes −140 V relative to the developing bias of −400 V since the charging bias is fixed. On the other hand, weak exposure of an intensity of 0.012 μJ/cm$^2$ is performed in the sheet interval so that a post-exposure potential in a sheet interval between first and second sheets becomes −530 V which is lower than a post-charge pre-exposure potential (the dark area potential (Vd)) at the time of the image forming operation by an absolute value of 20 V. After images are formed for 20 sheets, the weak exposure of an intensity further enhanced by 0.012 μJ/cm$^2$ is performed on a dark area. By this, although the dark area potential (Vd1) is approximately −550 V when the image forming operation is performed, the post-exposure potential (Vd) in a sheet interval between a 21-st sheet and a 22-nd sheet is approximately −510 V. The intensity of the weak exposure in the sheet interval is increased by 0.012 μJ/cm$^2$ every 20 copies until a 60-th sheet so that the dark area potential (Vd) is changed from −530 V to −490 V. After a 61-st sheet, the intensity is increased by 0.006 μJ/cm$^2$ every 20 copies, the dark area potential (Vd) is further changed by −20 V, and a post-exposure potential in a sheet interval between a 99-th sheet and a 100-th sheet is controlled to be −450 V.

In a state in which the charging bias is fixed, in a case where the image formation is consecutively performed before the cleaning, control is performed such that an amount of exposure in a first interval time become smaller than that in a second interval time which comes after the first interval time. By this, the dark area potential (Vd) may be stably changed. Accordingly, color mixture and an adverse effect in an image caused by discharge may be suppressed by controlling a discharge amount for each number of sheets subjected to the image formation also in the third embodiment. Therefore, since a cleaning operation execution timing in the consecutive image formation may be delayed by suppressing the problems as described above, the number of times cleaning is performed and a downtime may be reduced.

Fourth Embodiment

Figure 12:
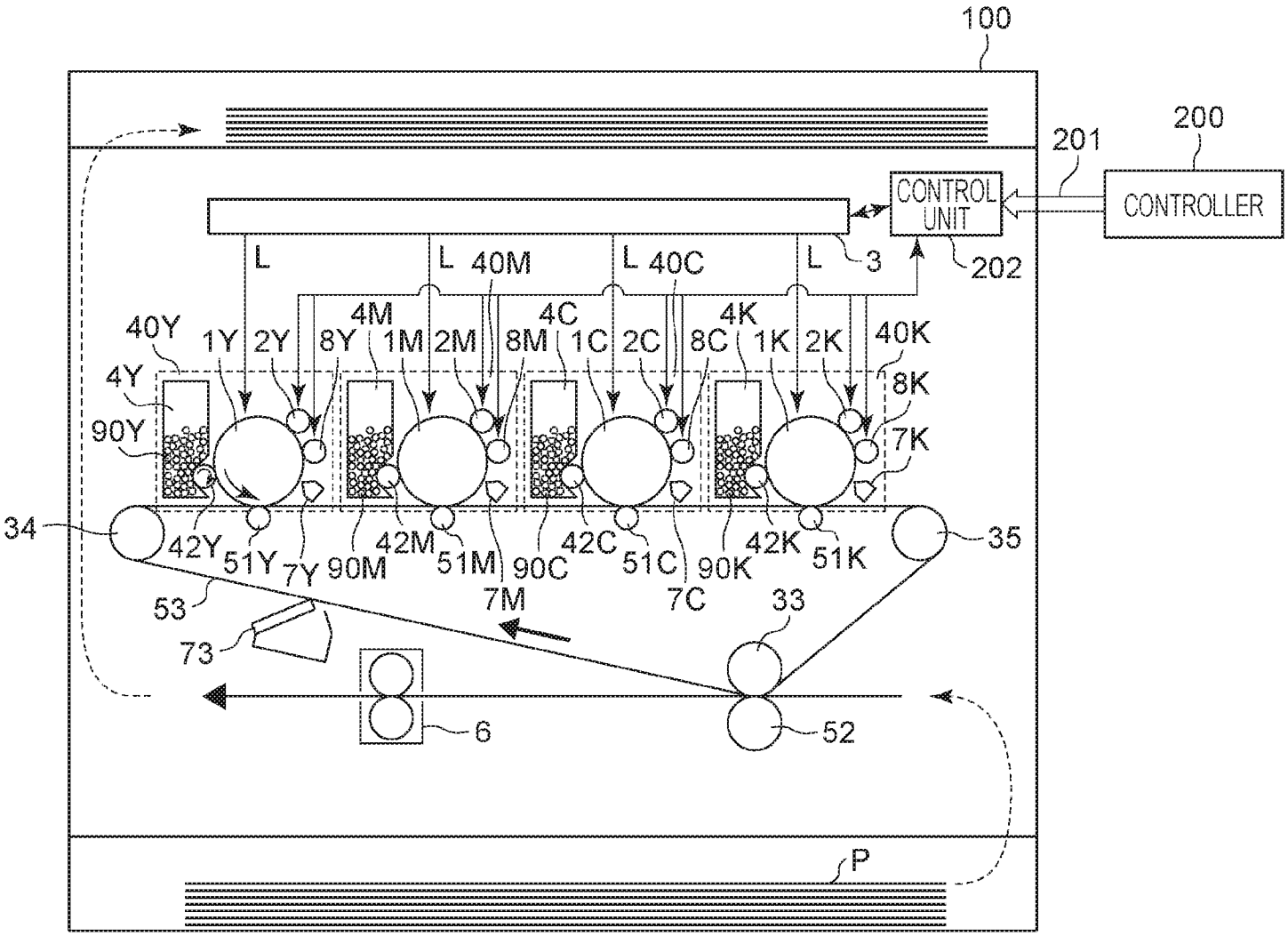
FIG. 12 is a diagram schematically illustrating an image forming apparatus according to a fourth embodiment.

In a fourth embodiment, a developer collecting roller 8 serving as a developer holding member is disposed in a portion on a downstream side relative to a pre-charge exposure device 7 and on an upstream side relative to a contact portion between a charging roller 2 and a photosensitive drum 1 in a rotation direction of the photosensitive drum 1 as illustrated in FIG. 12. The developer collecting roller 8 is brought into contact with a transfer remaining toner and a retransferred toner before the charging roller 2 so as to collect the retransferred toner, and therefore, the charging roller 2 is not contaminated. Accordingly, since a function of the image formation and a function of toner collection may be performed by the charging roller 2 and the developer collecting roller 8, respectively, in a separated manner, and therefore, the image formation may be performed without causing charging failure in the charging roller 2 due to attachment of the toner. A developer holding bias may be applied to the developer collecting roller 8 by a developer holding bias applying unit, not illustrated. A timing when the developer holding bias is applied and an operation in cleaning are the same as those of the charging bias according to the first embodiment. In a case where the image formation is consecutively executed before the cleaning, control is performed such that an absolute value of a holding bias to be applied in a second interval time is larger than that in a first interval time which comes before the second interval time. In a case where the image formation is consecutively executed after the cleaning, an absolute value of the holding bias to be applied in a first interval time is controlled to be smaller than that to be applied in a last interval time which is immediately before the cleaning. Furthermore, discharge may be gradually enhanced by gradually increasing the absolute value of the holding bias applied in the interval time until the cleaning period. When the cleaning is performed, the charging roller 2 applies a charging bias in a direction in which a toner transferred from the developer collecting roller 8 to the photosensitive drum 1 is to be passed. By this, the charging roller 2 may be controlled not to affect the cleaning operation. A positive bias and a negative bias may be applied to the developer collecting roller 8, and therefore, a potential may be selected in accordance with a polarity of the toner.

Accordingly, color mixture and an adverse effect in an image caused by discharge may be suppressed by controlling a discharge amount in an interval time for each number of sheets subjected to the image formation also in the fourth embodiment. Since a cleaning operation execution timing in the consecutive image formation may be delayed by suppressing the problems as described above, the number of times cleaning is performed and a downtime may be reduced.

Furthermore, the developer collecting roller 8 is disposed in a case where a retransferred toner of an opposite polarity is electrically attached to the charging roller 2 and the toner is required to be collected by the belt cleaning member 73. Accordingly, the developer collecting roller 8 is not disposed in a process cartridge 40 disposed on an uppermost stream of an intermediate transfer belt 53. Although a roller is employed in the developer holding member, the shape is not limited to a roller and a contact member of a brush shape may be employed.

Fifth Embodiment

Figure 13:
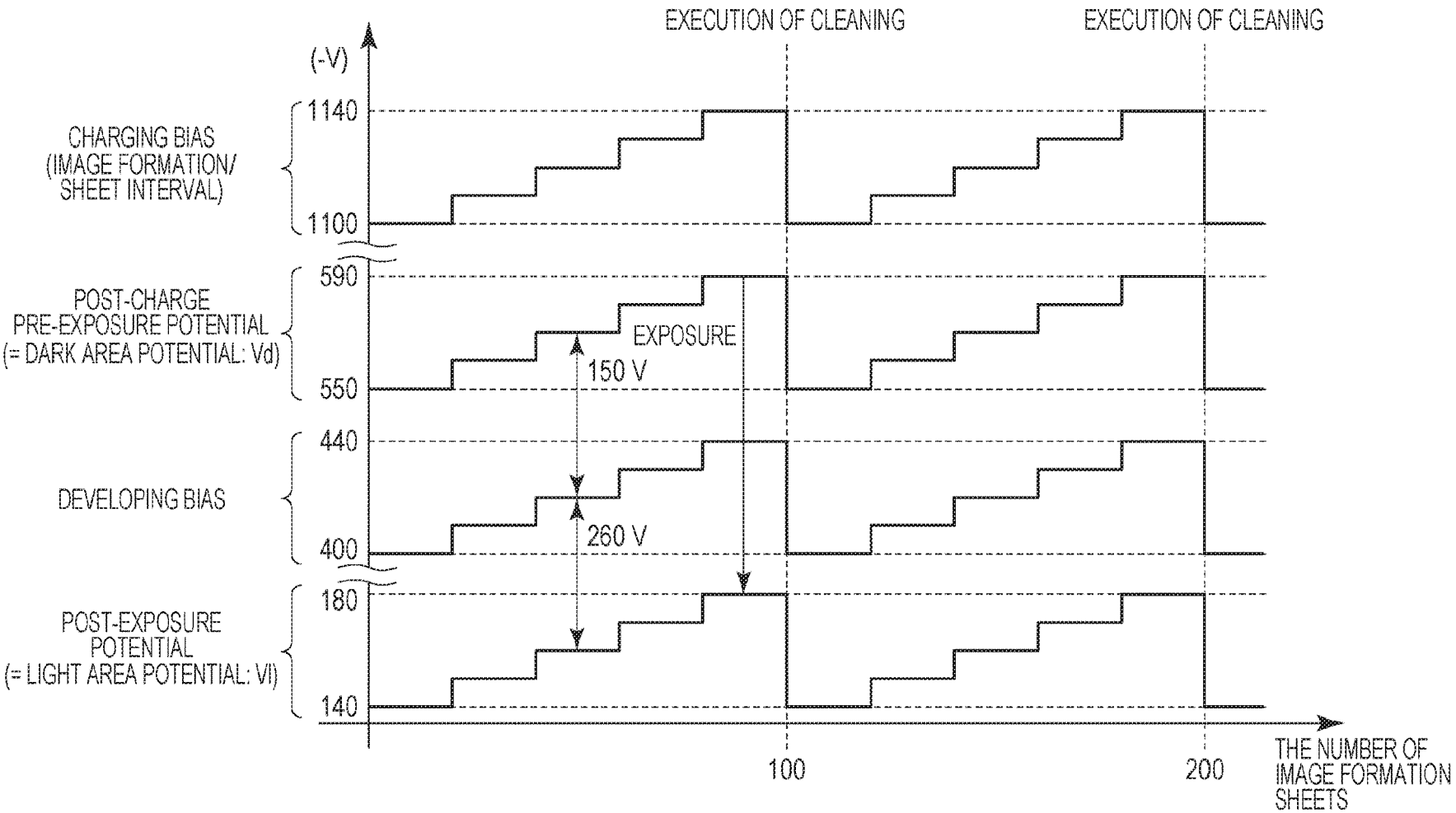
FIG. 13 is a diagram illustrating the relationship between a bias and a potential according to a fifth embodiment.

In a fifth embodiment, not only a discharge amount in a sheet interval but also a discharge amount during an image forming operation is changed. Biases for the individual numbers of sheets during consecutive image forming operations are illustrated in FIG. 13. As with FIGS. 8, 10, and 11, FIG. 13 is a diagram illustrating the relationship between the number of sheets denoted by an axis of abscissae and a bias denoted by an axis of ordinates. In the fifth embodiment, a charging bias during the image forming operation and a charging bias in the sheet interval are changed by −10 V every 20 sheets subjected to the image formation similarly to the first embodiment. In this way, a potential difference between a photosensitive drum 1 and a charging roller 2 is gradually increased by gradually increasing an absolute value of the charging bias during the image forming operation in accordance with the number of sheets subjected to the image formation. Furthermore, since a discharge amount is controlled not only in the sheet interval but also during the image forming operation, a period of time required for controlling the discharge amount becomes long, and therefore, an each amount of increase in the charging bias may be reduced. Accordingly, a large amount of discharge is not performed within a short period of time, and therefore, an effect for maintaining a polarity of a toner on the charging roller 2 may be attained while deterioration of the photosensitive drum 1 caused by the discharge is suppressed. Furthermore, a discharge amount is increased in a second half of the consecutive image formation, and accordingly, the polarity of the toner on the charging roller 2 may be maintained by the discharge.

However, if the charging bias is increased during the image forming operation, a potential difference between the charging bias and the developing bias is also changed, and therefore, the developing bias is simultaneously changed by −10 V. A potential difference between a dark area potential (Vd) of the photosensitive drum 1 and the developing bias is controlled in a fixed manner in a contact portion between the developing roller 42 and the photosensitive drum 1 so that the potential difference of approximately 150 V is maintained by simultaneously increasing the absolute value of the charging bias and the absolute value of the developing bias. Accordingly, occurrence of fog which is a phenomenon in which the toner is developed in the dark portion may be suppressed. The developing bias is appropriately set to a certain degree so that the fog does not occur. Furthermore, an intensity of exposure in an image portion is increased by 0.01 $\mu J/cm^2$ every 10 copies so that a light area potential (V1) is changed by −10 V every 10 copies. By this, a difference between the light area potential (V1) and the developing bias may be fixed to 260 V, and an image density in the consecutive image formation may be maintained. Furthermore, an amount of transfer remaining toner and an amount of retransferred toner are controlled by a transfer bias, and a pre-charge exposure device 7 controls a surface potential of the photosensitive drum 1 to approximately 0 V after primary transfer.

It is assumed that, when the consecutive image forming operation is performed while the charging bias is increased during the image forming operation and in the sheet interval, a charging bias of −1100 V is applied during image formation on a first sheet. Control is performed such that the charging bias is increased by an absolute value for every 20 sheets subjected to the image formation as illustrated in FIG. 13. For example, a charging bias applied during image formation on a 100-th sheet in the consecutive image formation is −1140 V.

As described above, by controlling not only the charging bias in the sheet interval which is the interval time but also the charging bias during the image forming operation, the discharge may be gradually enhanced in the sheet interval in the consecutive image formation, color mixture caused by a retransferred toner may be efficiently suppressed, and an adverse effect in an image caused by the discharge may be suppressed. Furthermore, when compared with a case where only the charging bias in the sheet interval is changed, even if an amount of increase in the charging bias is small, the effect may be attained. Therefore, a discharge amount may not be largely increased at a time. Since a cleaning operation execution timing in the consecutive image formation may be delayed by suppressing the adverse effect of the discharge and the color mixture, the number of times cleaning is performed and a downtime may be reduced.

Furthermore, as with the first embodiment, the developing roller 42 may be separated from the photosensitive drum 1 in the sheet interval or the developing roller 42 may be in contact with the photosensitive drum 1 while the bias relationship during the image forming operation is maintained in the fifth embodiment. Although the bias during the image forming operation and the bias in the sheet interval are changed in cooperation in the fifth embodiment, each of the biases may be independently changed.

Furthermore, the same effect may be attained even if the second and third embodiments are applied to the fifth embodiment.

Alternatively, as a method for changing a discharge amount between the charging roller 2 and the photosensitive drum 1, a transfer bias or a pre-charge exposure amount may be controlled under the conditions of the first to fifth embodiments. As the method, a transfer bias in the sheet interval is controlled so that a surface potential of the photosensitive drum 1 on a downstream side relative to a contact portion between the primary-transfer roller 51 and the photosensitive drum 1 and on an upstream side relative to a contact portion between the charging roller 2 and the photosensitive drum 1 in a rotation direction of the photosensitive drum 1 is fixed. Alternatively, the pre-charge exposure device 7 is controlled in the sheet interval so that the surface potential of the photosensitive drum 1 on a downstream side relative to the pre-charge exposure device 7 and on an upstream side relative to the contact portion between the charging roller 2 and the photosensitive drum 1 in a rotation direction of the photosensitive drum 1 is fixed. By this, as with the first embodiment, in a case where the charging bias in the sheet interval is changed in accordance with the consecutive image formation, an amount of discharge between the charging roller 2 and the photosensitive drum 1 may be changed. Specifically, a transfer bias in an interval time in which a charging bias of an absolute value which is relatively larger is applied is larger than a transfer bias in an interval time in which a charging bias of an absolute value which is relatively smaller is applied in consecutive printing. Alternatively, a discharge amount may be gradually increased by increasing the pre-charge exposure amount.

Furthermore, the same effect may be attained when the transfer bias and the pre-charge exposure amount are individually controlled without changing the charging bias and the exposure amount as described in the first to fifth embodiments. In a case where the image formation is consecutively executed before the cleaning, control is performed such that an absolute value of a transfer bias to be applied in a second interval time is larger than that in a first interval time which comes before the second interval time. Alternatively, control is performed such that the pre-charge exposure amount in exposure becomes large. By this, a surface potential of the photosensitive drum 1 positioned between the contact portion between the primary-transfer roller 51 and the photosensitive drum 1 and the contact portion between the charging roller 2 and the photosensitive drum 1 may be changed, and accordingly, a discharge amount between the charging roller 2 and the photosensitive drum 1 may be changed.

Accordingly, color variation caused by color mixture and an adverse effect in an image caused by discharge may be appropriately suppressed by controlling a discharge amount in a sheet interval during the consecutive image formation, and therefore, the number of times cleaning is performed and a downtime may be reduced.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2018-066096 filed Mar. 29, 2018, which is hereby incorporated by reference herein in its entirety.

What is claimed is:

1. An image forming apparatus which forms a toner image on a recording material, the image forming apparatus comprising:

a plurality of image forming units each of which includes an image bearing member, a charging member which performs contact charging on the image bearing member, an exposure unit which exposes the image bearing member charged by the charging member, and a developer bearing member which forms the toner image of a normal polarity on the image bearing member;

a charging voltage applying unit configured to apply a charging voltage to the charging member; and a controller configured to control the charging voltage applying unit, wherein a remaining toner which is not used in image formation and remains on the image bearing member is collected by the developer bearing member in an image forming operation of forming the toner image in each of the image forming units, wherein the controller controls the charging voltage applying unit such that the charging voltage is applied in a direction in which a toner charged in an opposite polarity relative to a toner charged in a normal polarity is moved from the image bearing member to the charging member in an image forming period for executing the image forming operation, and the charging voltage is applied in a direction in which the toner charged in the opposite polarity is moved from the charging member to the image bearing member in a cleaning period in which a cleaning operation of cleaning the charging member is performed, wherein, before the cleaning period, periods of time in which the image forming operation is executed to consecutively form the toner images on first to third recording materials in this order are determined as first to third image forming periods, respectively, a period of time which corresponds to an interval between the first and second image forming periods and in which the image forming operation is not executed is determined as a first interval time, and a period of time which corresponds to an interval between the second and third image forming periods and in which the image forming operation is not executed is determined as a second interval time, and wherein the controller controls the charging voltage applying unit such that, in the first and second interval times, the charging voltage of a polarity the same as a polarity of the charging voltage in the image forming period is applied, and an absolute value of the charging voltage in the second interval time is larger than an absolute value of the charging voltage in the first interval time.

2. The image forming apparatus according to claim 1, wherein, in a case where the image forming operation is consecutively performed after the cleaning period, the controller controls the charging voltage applying unit such that an absolute value of the charging voltage applied in the interval time between a first image forming period and a second image forming period is smaller than an absolute value of the charging voltage applied in the interval time between a third image forming period immediately before the cleaning period and a fourth image forming period before the third image forming period.

3. The image forming apparatus according to claim 1, wherein the controller controls the charging voltage applying unit such that, in a case where the image forming operation is consecutively executed before the cleaning period, an absolute value of the charging voltage applied in the interval time is gradually increased toward the cleaning period.

4. The image forming apparatus according to claim 1, further comprising:

a developing voltage applying unit configured to apply a developing voltage to the developer bearing member, wherein the exposure unit also exposes a non-image portion on a surface of the image bearing member, and an amount of the exposure to the non-image portion is in a range in which a post-exposure potential of the non-image portion is not smaller than an absolute value of the developing voltage applied by the developing voltage applying unit, and wherein the controller controls the exposure unit such that, as an absolute value of the charging voltage applied to the charging member is increased, an amount of exposure to the non-image portion is increased in the interval time.

5. The image forming apparatus according to claim 4, wherein the controller controls the exposure unit such that a post-exposure potential of the non-image portion of the image bearing member generated by the exposure to the non-image portion is constant in the interval time irrespective of an absolute value of the charging voltage.

6. The image forming apparatus according to claim 4, wherein the controller controls the exposure unit such that the amount of exposure to the non-image portion in the interval time between a first image forming period and a second image forming period is smaller than an amount of exposure to the non-image portion in the interval time between a third image forming period immediately before the cleaning period and a fourth image forming period before the third image forming period, in a case where the image forming operation is consecutively executed immediately after the cleaning period.

7. The image forming apparatus according to claim 4, wherein the controller controls the exposure unit such that the amount of exposure to the non-image portion is gradually increased in the interval time toward the cleaning period in a case where the image forming operation is consecutively executed before the cleaning period.

8. The image forming apparatus according to claim 1, wherein the cleaning period is executed immediately after the image forming period is terminated.

9. The image forming apparatus according to claim 1, wherein the controller performs control such that an absolute value of the charging voltage applied to the charging member by the charging voltage applying unit in the interval time is changed in accordance with the number of copies in the image forming period, a rotation speed of the image bearing member, or an accumulation value of a printing ratio of the toner image formed on the image bearing member, in a case where the image forming operation is consecutively executed.

10. The image forming apparatus according to claim 4, wherein the controller performs control such that at least one of an absolute value of the charging voltage applied to the charging member by the charging voltage applying unit in the interval time and the amount of exposure to the non-image portion of the image bearing member is changed in accordance with the number of copies in the image forming period, a rotation speed of the image bearing member, or an accumulation value of a printing ratio of the toner image formed on the image bearing member, in a case where the image forming operation is consecutively executed.

11. The image forming apparatus according to claim 1, wherein the cleaning period is provided when the number of copies in the image forming period, a rotation speed of the image bearing member, or an accumulation value of a printing ratio of the toner image formed on the image bearing member reaches a predetermined amount, in a case where the image forming operation is consecutively executed.

12. The image forming apparatus according to claim 1, further comprising:

a transfer member included in a transfer unit which transfers the toner image developed on a surface of the image bearing member of the image forming unit to a recording material; and a transfer voltage applying unit configured to apply a transfer voltage to the transfer member, wherein the controller controls the transfer voltage applying unit such that, as an absolute value of the charging voltage applied to the charging member is increased, the transfer voltage is increased in the interval time.

13. The image forming apparatus according to claim 1, further comprising:

an intermediate transfer member configured to bear a plurality of colors of the toner images on the surface which are successively transferred from the image bearing bodies in the plurality of image forming units; and a cleaning member configured to collect the toner image transferred on the intermediate transfer member, wherein the toner moved onto the image bearing member in the cleaning period is transferred onto the intermediate transfer member and the toner is collected by the cleaning member.

14. The image forming apparatus according to claim 13, wherein the cleaning operation is not performed on the image forming unit which is disposed on an uppermost stream in a rotation direction of the intermediate transfer member.

15. The image forming apparatus according to claim 13, further comprising:

a second exposure unit configured to expose the image bearing member of the image forming unit, the second exposure unit exposing a surface of the image bearing member on a downstream side relative to a contact portion between the intermediate transfer member and the image bearing member and on an upstream side relative to a contact portion between the charging member and the image bearing member in the rotation direction of the image bearing member, wherein the controller controls the exposure unit such that, as an absolute value of the charging voltage applied to the charging member is increased, an amount of exposure performed by the second exposure unit is increased in the interval time.

16. An image forming apparatus which forms a toner image on a recording material, the image forming apparatus comprising:

a plurality of image forming units each of which includes an image bearing member, a charging member which performs contact charging on the image bearing member, an exposure unit which exposes the image bearing member charged by the charging member, a developer bearing member which forms the toner image of a normal polarity on the image bearing member, and a holding member which holds a remaining toner which is not used in printing and remains on the image bearing member;

a holding voltage applying unit configured to apply a holding voltage to the holding member; and a controller configured to control the holding voltage applying unit, wherein the remaining toner which is not used in image formation and remains on the image bearing member is collected by the developer bearing member in an image forming operation of forming the toner image in each of the image forming units, wherein the controller controls the holding voltage applying unit such that the holding voltage is applied in a direction in which a toner charged in an opposite polarity relative to a toner charged in a normal polarity is moved from the image bearing member to the holding member in an image forming period for executing the image forming operation, and the holding voltage is applied in a direction in which the toner charged in the opposite polarity is moved from the holding member to the image bearing member in a cleaning period in which a cleaning operation of cleaning the holding member is performed, wherein, before the cleaning period, periods of time in which the image forming operation is executed to consecutively form the toner images on first to third recording materials in this order are determined as first to third image forming periods, respectively, a period of time which corresponds to an interval between the first and second image forming periods and in which the image forming operation is not executed is determined as a first interval period, and a period of time which corresponds to an interval between the second and third image forming periods and in which the image forming operation is not executed is determined as a second interval period, and wherein the controller controls the holding voltage applying unit such that, in the first and second interval periods, the holding voltage of a polarity the same as a polarity of the holding voltage in the image forming period is applied, and an absolute value of the holding voltage in the second interval period is larger than an absolute value of the holding voltage in the first interval period.

17. The image forming apparatus according to claim 16, wherein, in a case where the image forming operation is consecutively performed after the cleaning period, the charging voltage applying unit is controlled such that an absolute value of the holding voltage applied in the interval time between a first image forming period and a second image forming period is smaller than an absolute value of the holding voltage applied in the interval time between a third image forming period immediately before the cleaning period and a fourth image forming period before the third image forming period.

18. The image forming apparatus according to claim 16, wherein the controller controls the holding voltage applying unit such that, in a case where the image forming operation is consecutively executed before the cleaning period, an absolute value of the holding voltage applied in the interval time is gradually increased toward the cleaning period.

19. The image forming apparatus according to claim 1, wherein the toner is a one-component developer.

* * * * *